US007591401B2

(12) United States Patent
Sandler

(10) Patent No.: US 7,591,401 B2
(45) Date of Patent: Sep. 22, 2009

(54) WEARABLE TRAY SYSTEM

(76) Inventor: Jeffrey Lawrence Sandler, 7021 Mary Ellen Ave., North Hollywood, CA (US) 91605

( * ) Notice: Subject to any disclaimer, the term of this patent is extended or adjusted under 35 U.S.C. 154(b) by 716 days.

(21) Appl. No.: 11/054,099

(22) Filed: Feb. 8, 2005

(65) Prior Publication Data

US 2006/0175365 A1 Aug. 10, 2006

(51) Int. Cl.
*A45F 3/10* (2006.01)
*A47B 96/00* (2006.01)

(52) U.S. Cl. ..... 224/201; 224/265; 224/266; 248/225.11; 403/108

(58) Field of Classification Search ..... 224/201, 224/265, 910; 248/225.11, 224.7, 274.1, 248/224.8; 403/393, 108; 74/586
See application file for complete search history.

(56) References Cited

U.S. PATENT DOCUMENTS 3,523,702 A * 8/1970 Unti et. al. ..... 403/107
4,190,377 A * 2/1980 Pleuss ..... 403/108
4,378,173 A * 3/1983 Hopwell ..... 403/108
4,450,993 A * 5/1984 Ephraim ..... 224/265
4,786,081 A * 11/1988 Schmidt ..... 280/801.2
4,799,610 A * 1/1989 Hsieh ..... 224/266
5,074,222 A * 12/1991 Welch ..... 108/43
5,205,588 A * 4/1993 Yamaoka et al. ..... 280/801.2
D352,053 S * 11/1994 Murray ..... D17/20
5,464,137 A * 11/1995 Shirdavani ..... 224/265
5,573,158 A * 11/1996 Penn ..... 224/265
6,012,691 A * 1/2000 van Leeuwen et al. ... 248/228.3

OTHER PUBLICATIONS www.bvmjets.com/accessories/tray.htm.
www.modelhelikopter.ch/elektroniku.htm.
www.flairproducts.co.uk/radio/txaccessories.htm.
www.aerosports.com/ponteri/news/tray/supertray.html.
www.pandanmodelboats.co.uk/acatalog.
http://webpages.charter.net/rcfu/constguide/xmtray.html.

* cited by examiner

*Primary Examiner*—Nathan J Newhouse
*Assistant Examiner*—Lester L Vanterpool
(74) *Attorney, Agent, or Firm*—Steptoe & Johnson LLP

(57) ABSTRACT

Design for construction of a wearable tray system is disclosed. The wearable tray system is adjustable in multiple dimensions including width, length, positioning of trays and multi-functional tilt wrist rests. 'Wave-grip' technology is utilized to provide for secure tool-free incremental lengthening and shortening of structural members. Further, multiple lockdown systems are disclosed for removably securing various objects to the trays of the system.

3 Claims, 24 Drawing Sheets

WEARABLE TRAY SYSTEM

Figure 1:
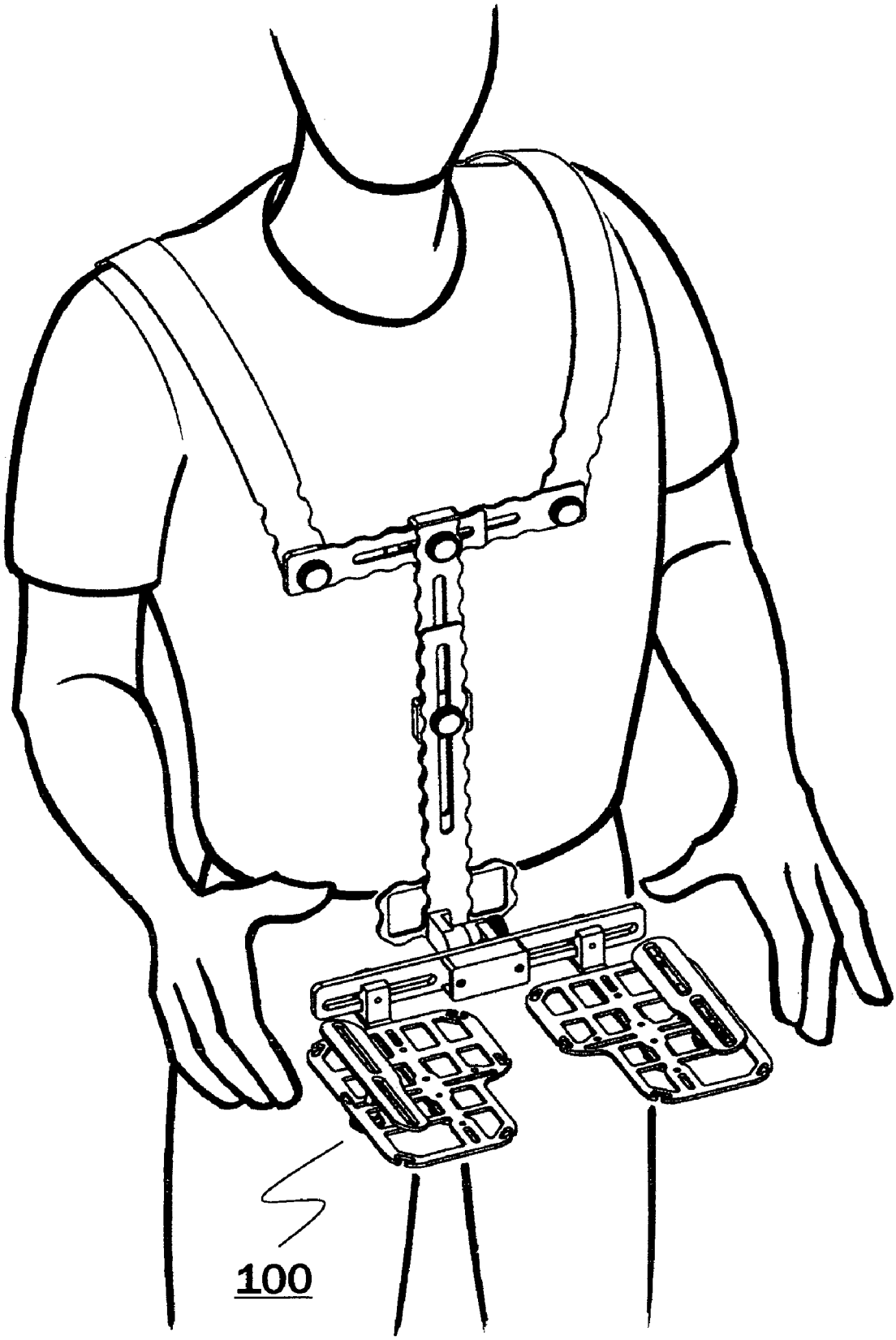

BACKGROUND OF THE INVENTION (1) Field of Invention

The current invention relates to the field of wearable tray systems. It also relates to the field of structural members of incrementally adjustable length.

(2) Description of Prior Art

There currently exist a number of different models of wearable tray systems on the market designed to harness onto a wearer to provide a tray space in front of the body for supporting any of various items desired. Generally, those extant tray systems use one of several harnessing mechanisms to attach some form of neck-strap directly, or via extension, to the trays. One disadvantage of these 'neck-strap' models of wearable tray systems is the danger of a propeller blade becoming entangled in these neck straps and creating a potentially hazardous situation. However some no longer available wearable tray systems did use shoulder straps rather than neck straps—e.g. 'Tray-Table' or the Dubro™ transmitter tray. All The currently and previously available models of wearable tray systems known to the inventor have very limited or no adjustability. Further, the inventor is not aware of any other wearable tray systems which suggest or offer capacity for the multiple uses of the present invention. Many extant wearable tray systems are designed very specifically to hold one type of transmitter only and for this reason, would be virtually useless for any other purpose. Although no search of previously issued patents has been performed, searching for 'transmitter trays' on the internet yields information on a variety of devices currently on the market. Some of those found which the inventor considers to be the closest prior art include:

BVM Transmitter tray found at:

www.bvmjets.com/accessories/tray.htm;

Transmitter trays MC-14, MC-16, MC-20, MC-22, MC-24 Graupner and FC-15, FC-18,FC-28 Futaba and MPX 3030 found at:

www.modelhelikopter.ch/elektroniku.htm;

MX85 series transmitter trays found at:

www.flairproducts.co.uk/radio/txaccessories.htm;

Robart Transmitter Super Tray found at:

www.aero-sports.com/ponteri/news/tray/supertray.html;

Robbe transmitter trays found at:

www.pandanmodelboats.co.uk/acatalog/;

and C.B. associates metal transmitter tray;

as well as instructions for building a transmitter tray found at http://webpages.charter.net/rcfu/constguide/xmtrtray.html;

BRIEF DESCRIPTION OF THE DRAWING FIGURES

All references to right and left are from the wearer's point of view. E.g. The right shoulder strap fits over the wearer's right shoulder while the left shoulder strap fits over the wearer's left shoulder.

FIG. 1—An example of an assembled wearable tray system

Figure 2A:
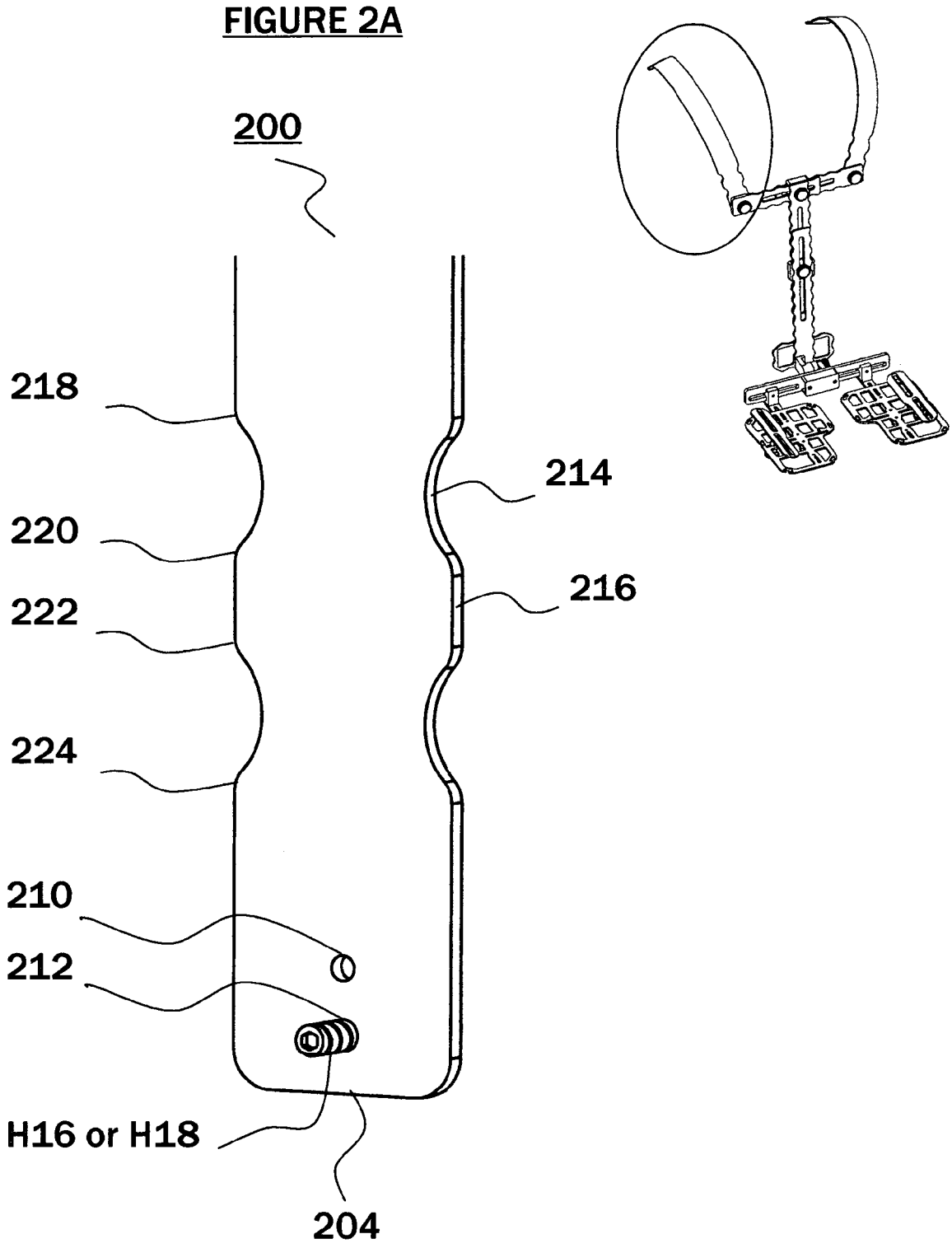

FIG. 2A—A partial front view of an example of a shoulder strap

Figure 2B:
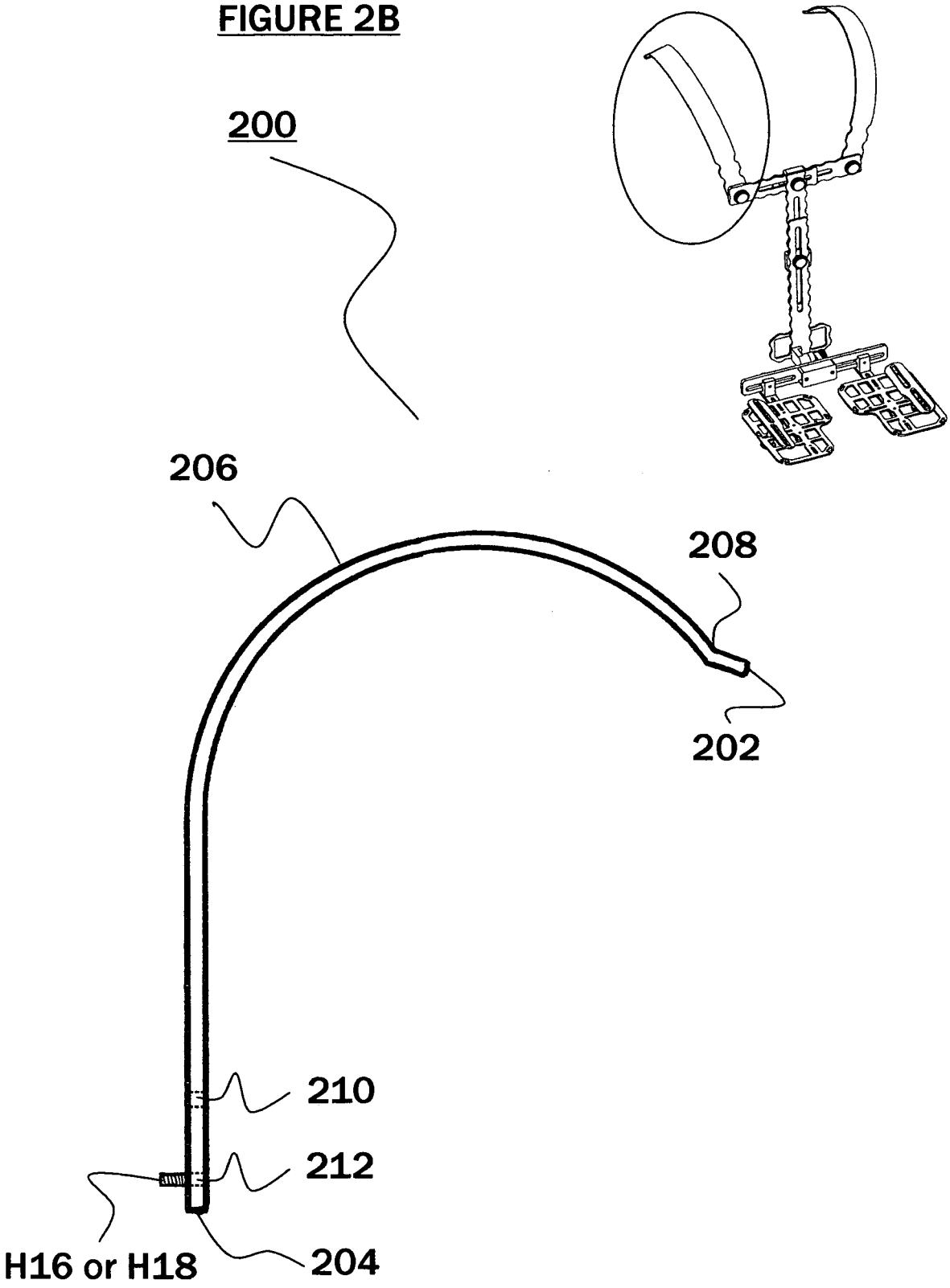

FIG. 2B—Side view of an example of a shoulder strap

Figure 2C:
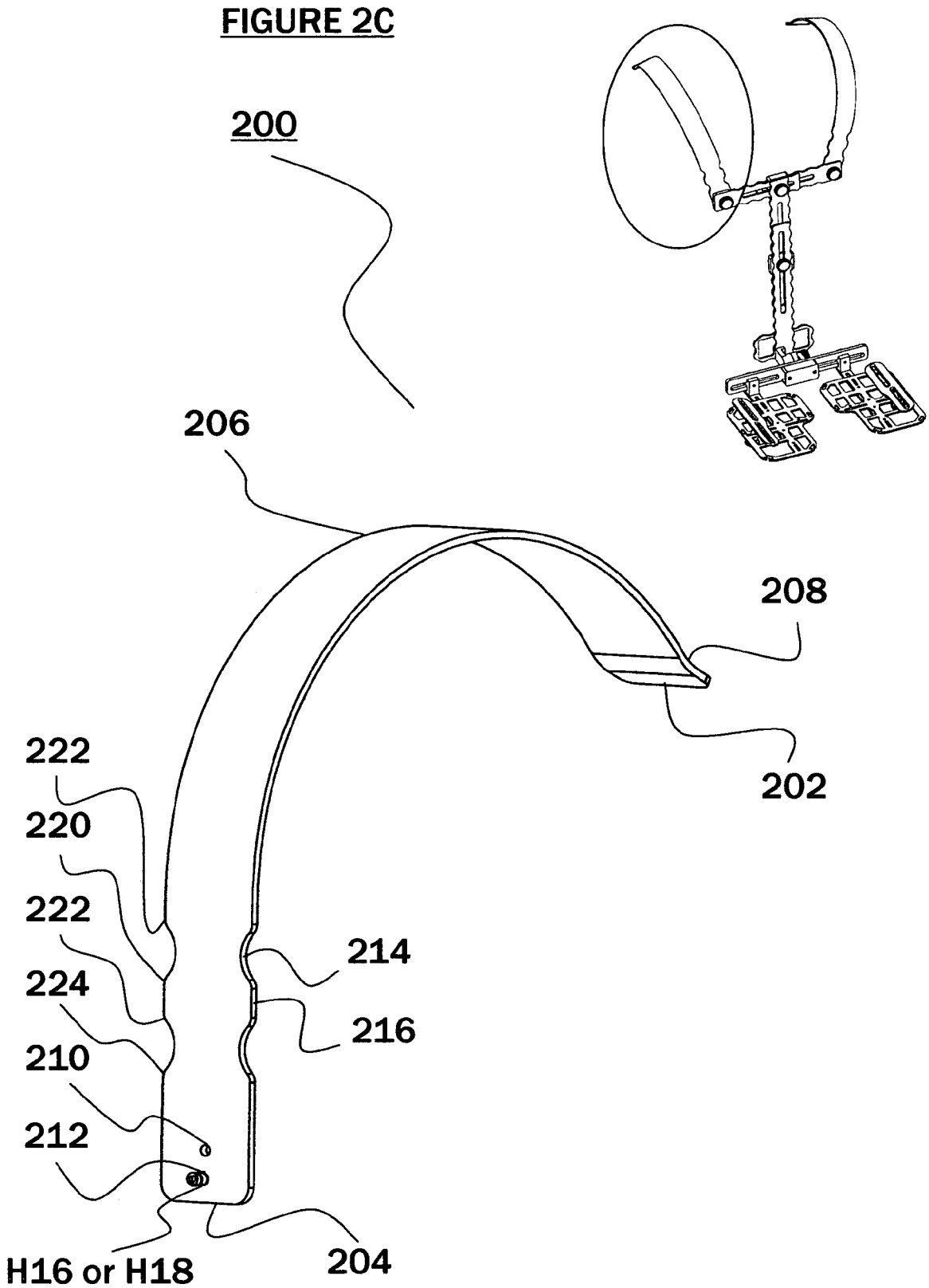

FIG. 2C—Oblique view of an example of a shoulder strap

Figure 3:
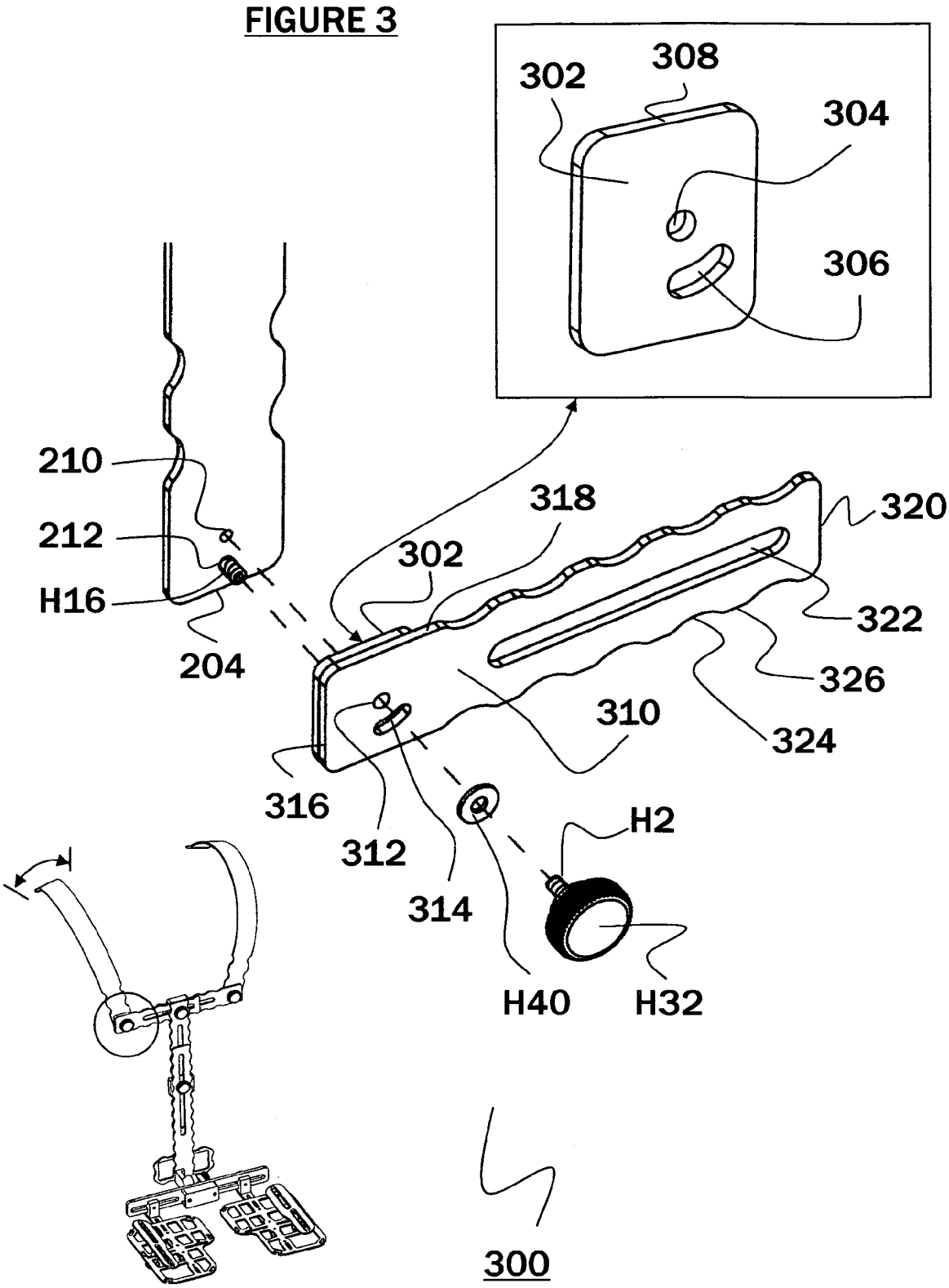

FIG. 3—An example of a right shoulder strap/upper cross bar assembly

Figure 4:
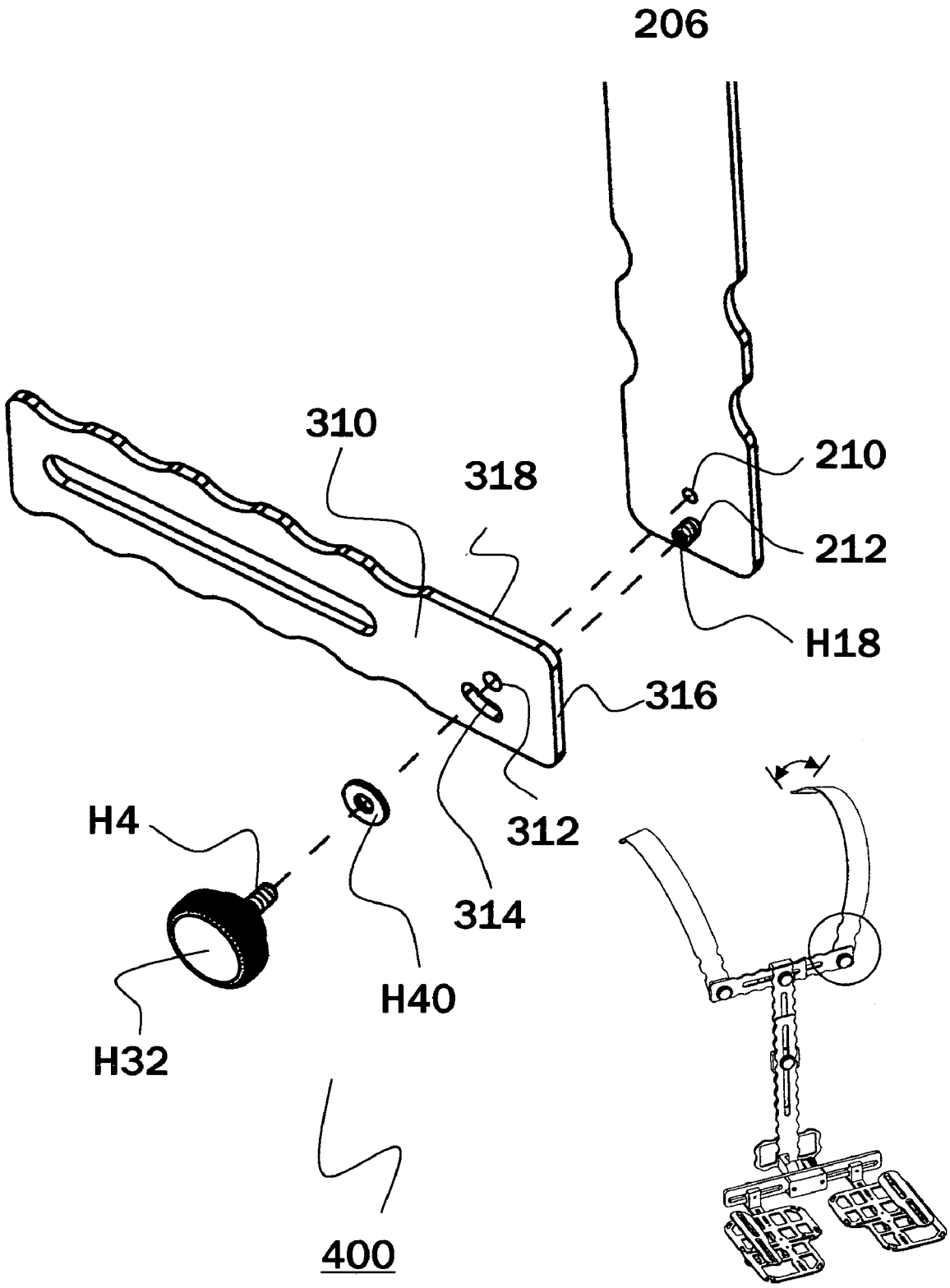

FIG. 4—An example of a left shoulder strap/upper cross bar assembly

Figure 5:
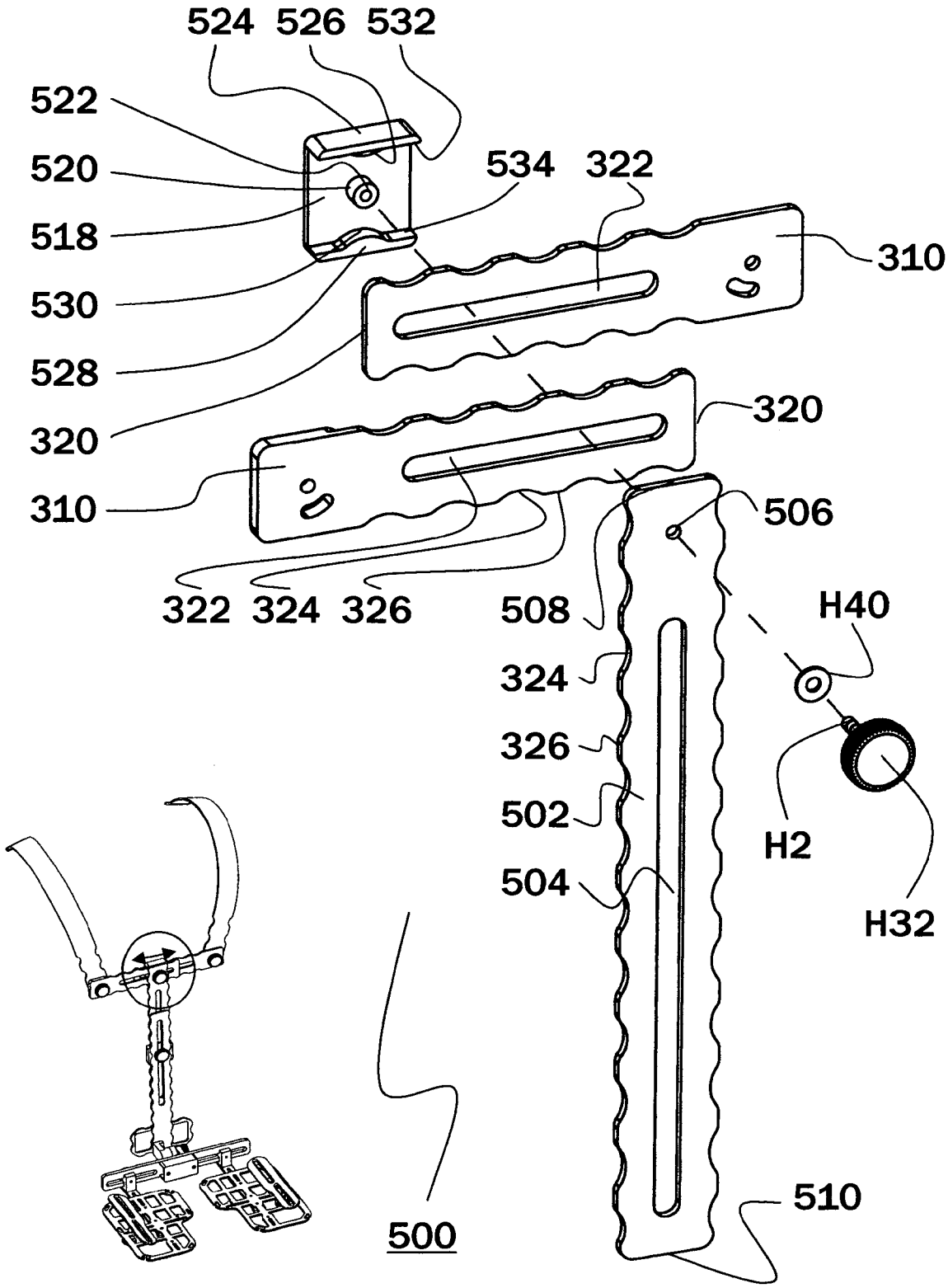
Figure 6:
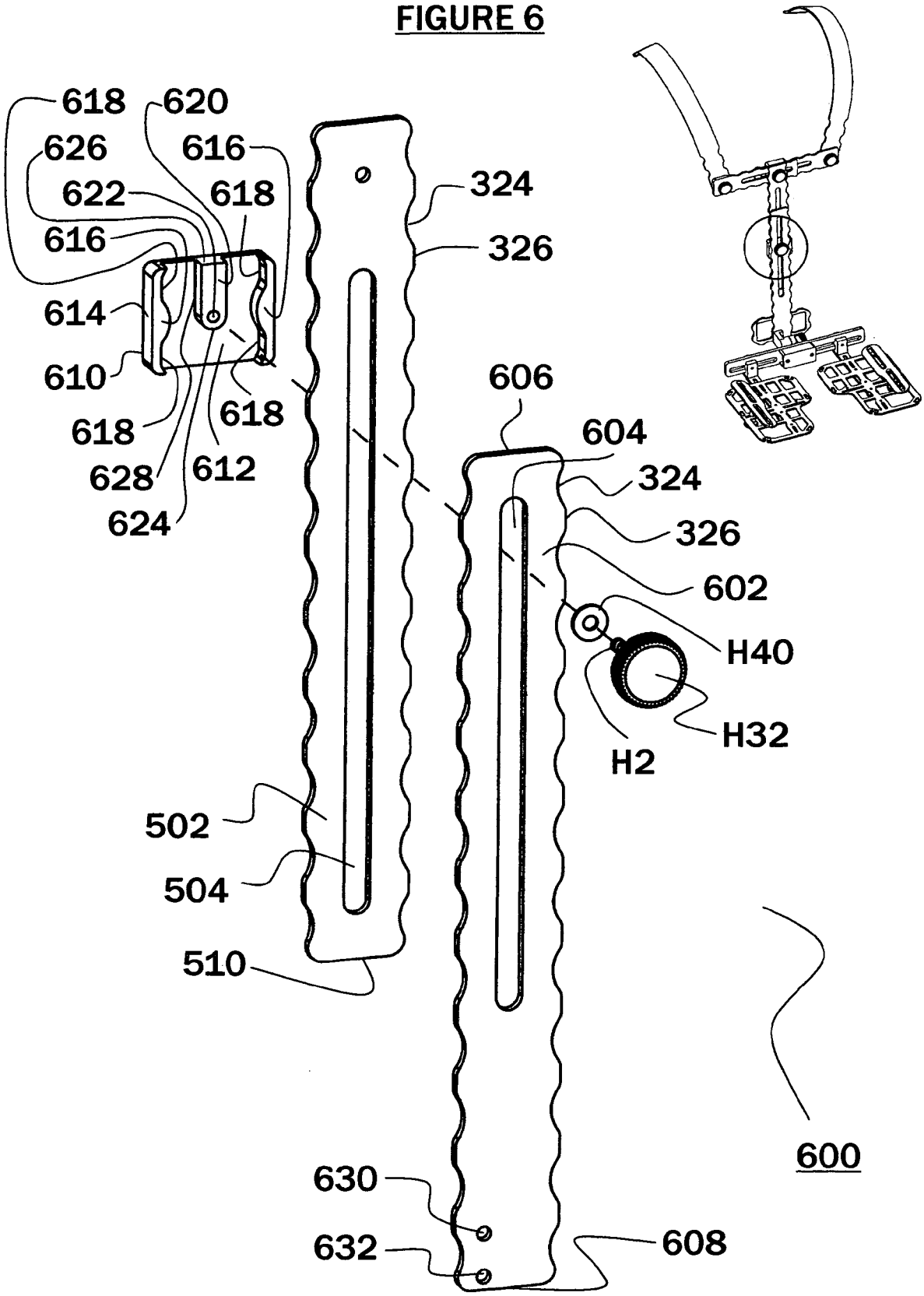
Figure 7:
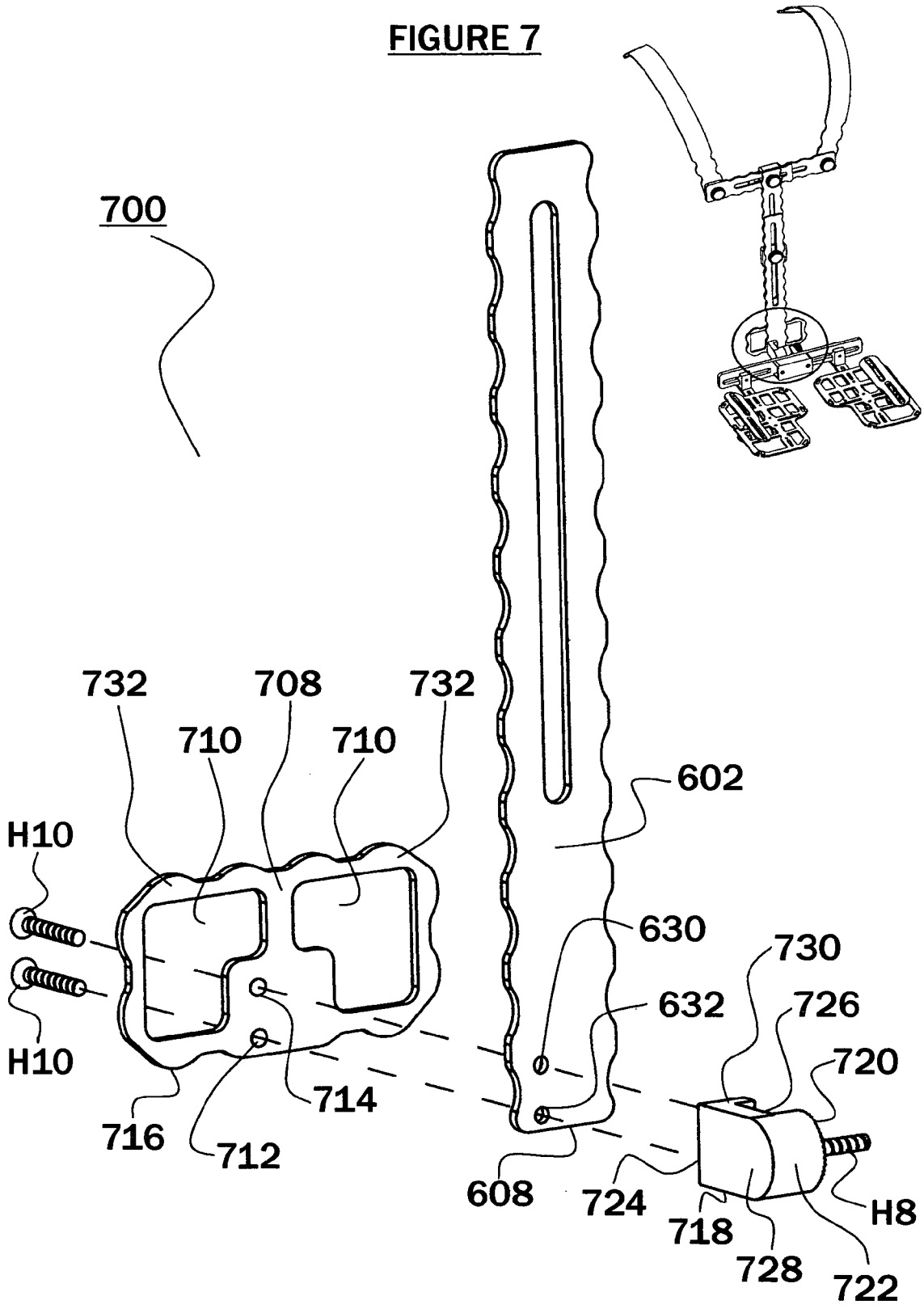
Figure 8A:
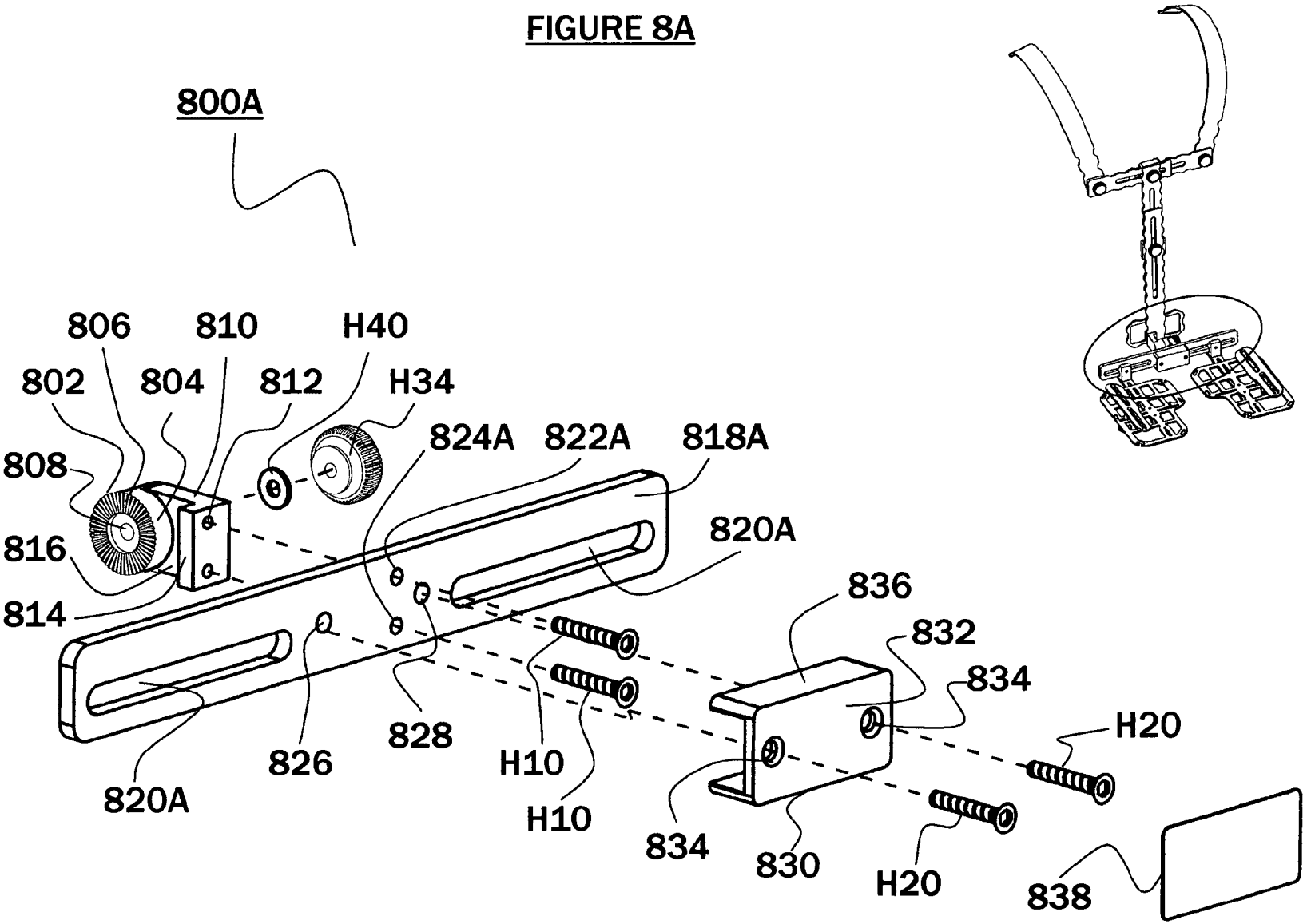
Figure 8B:
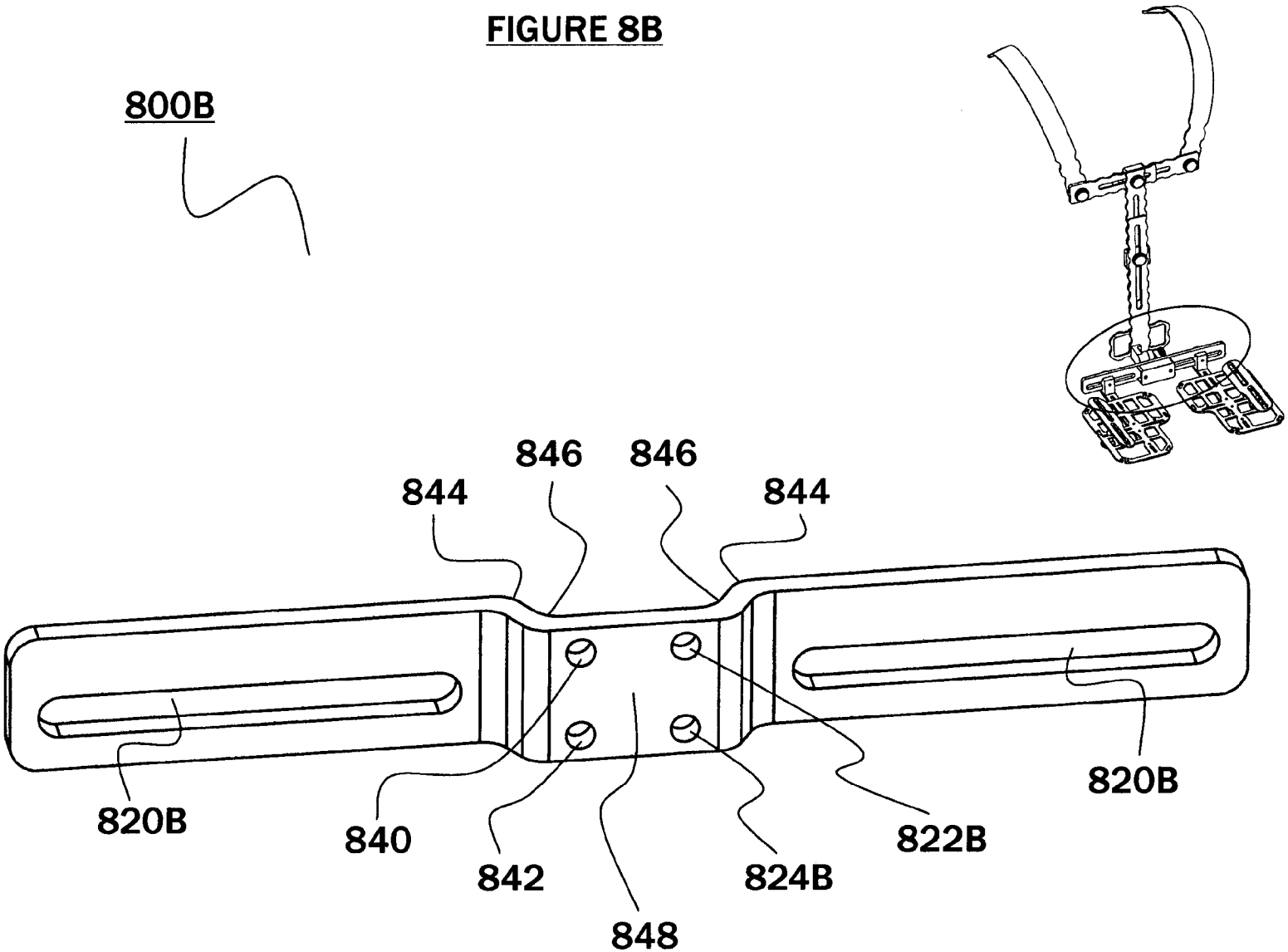
Figure 8C:
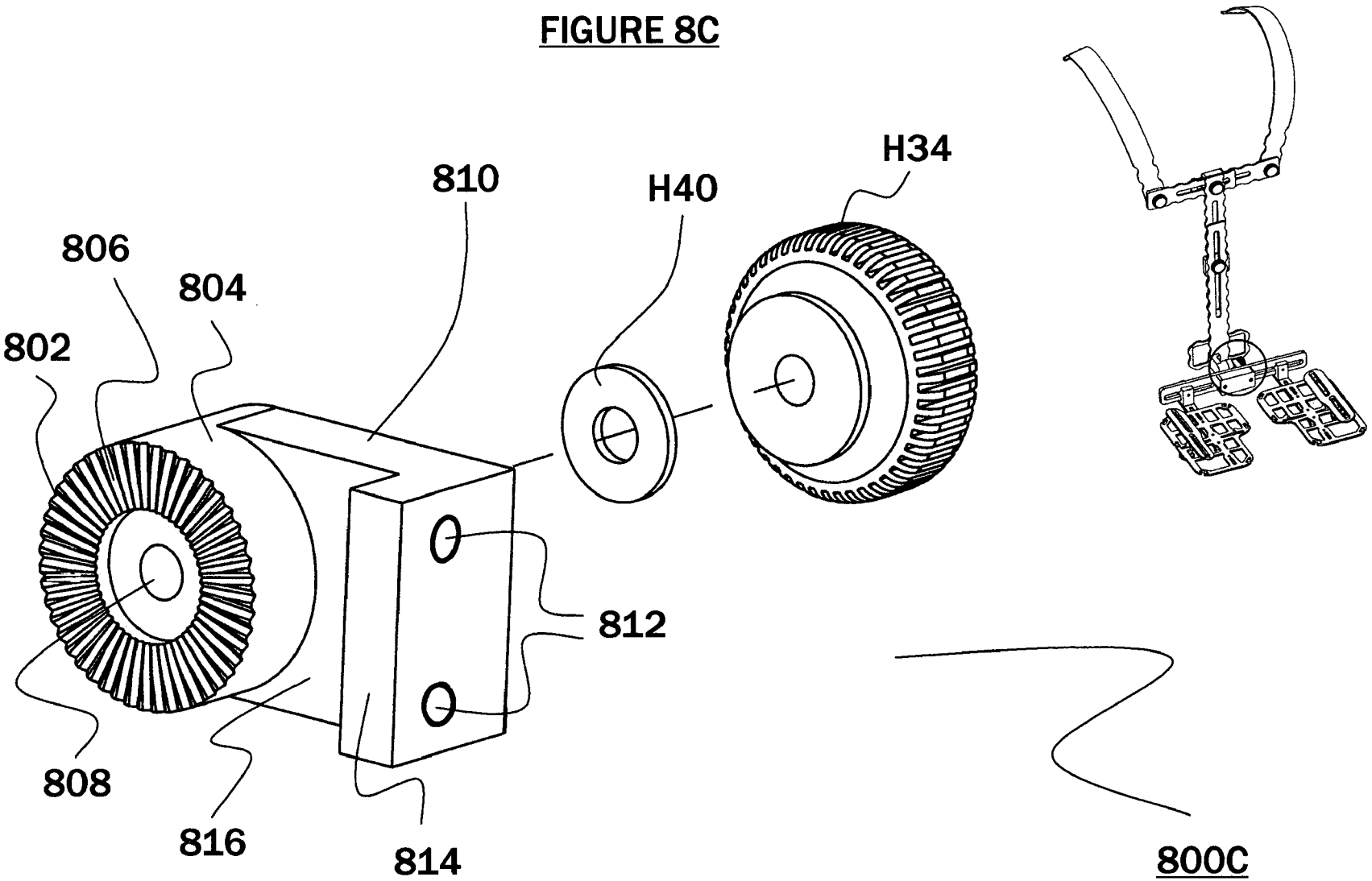
Figure 9A:
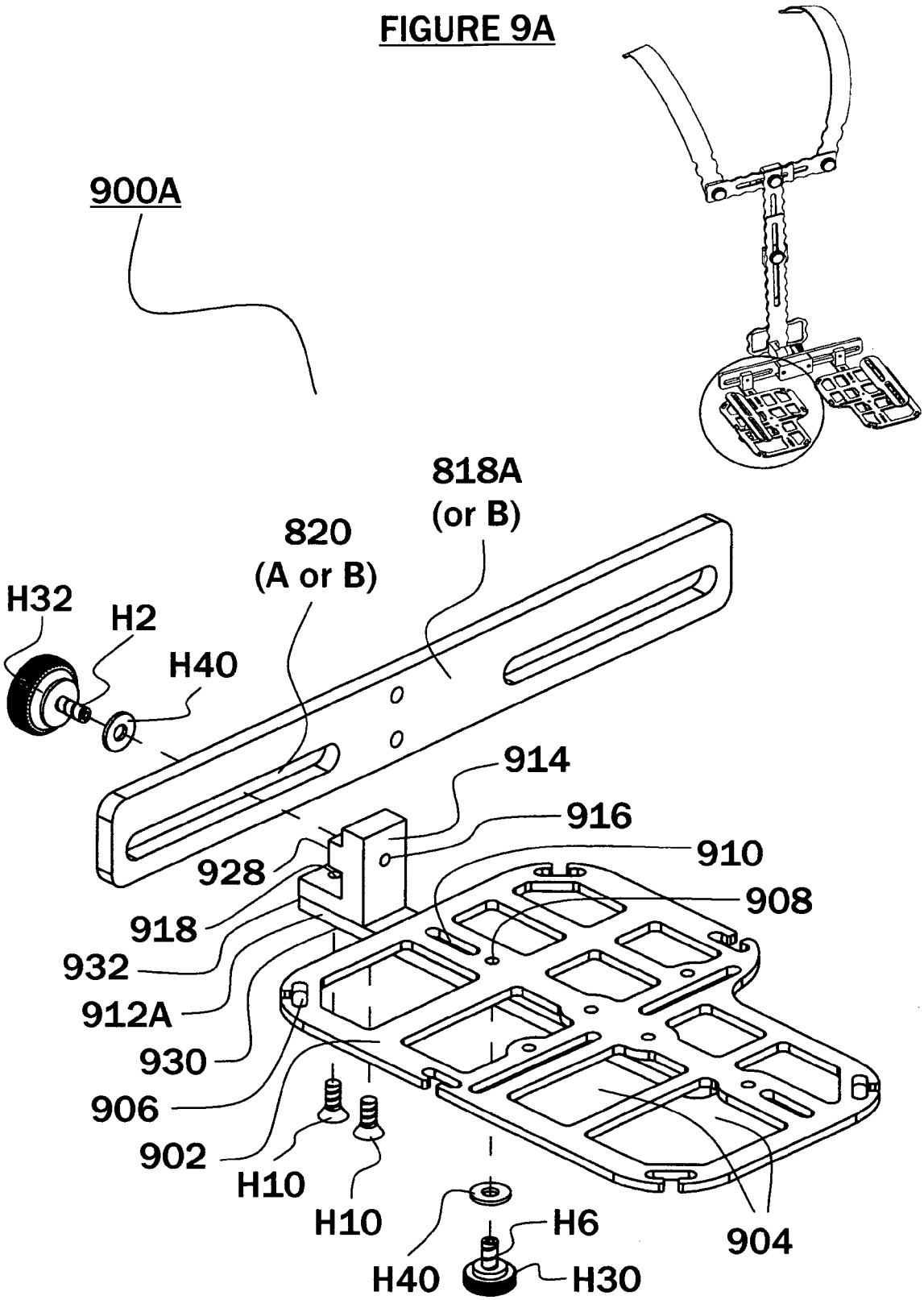
Figure 9B:
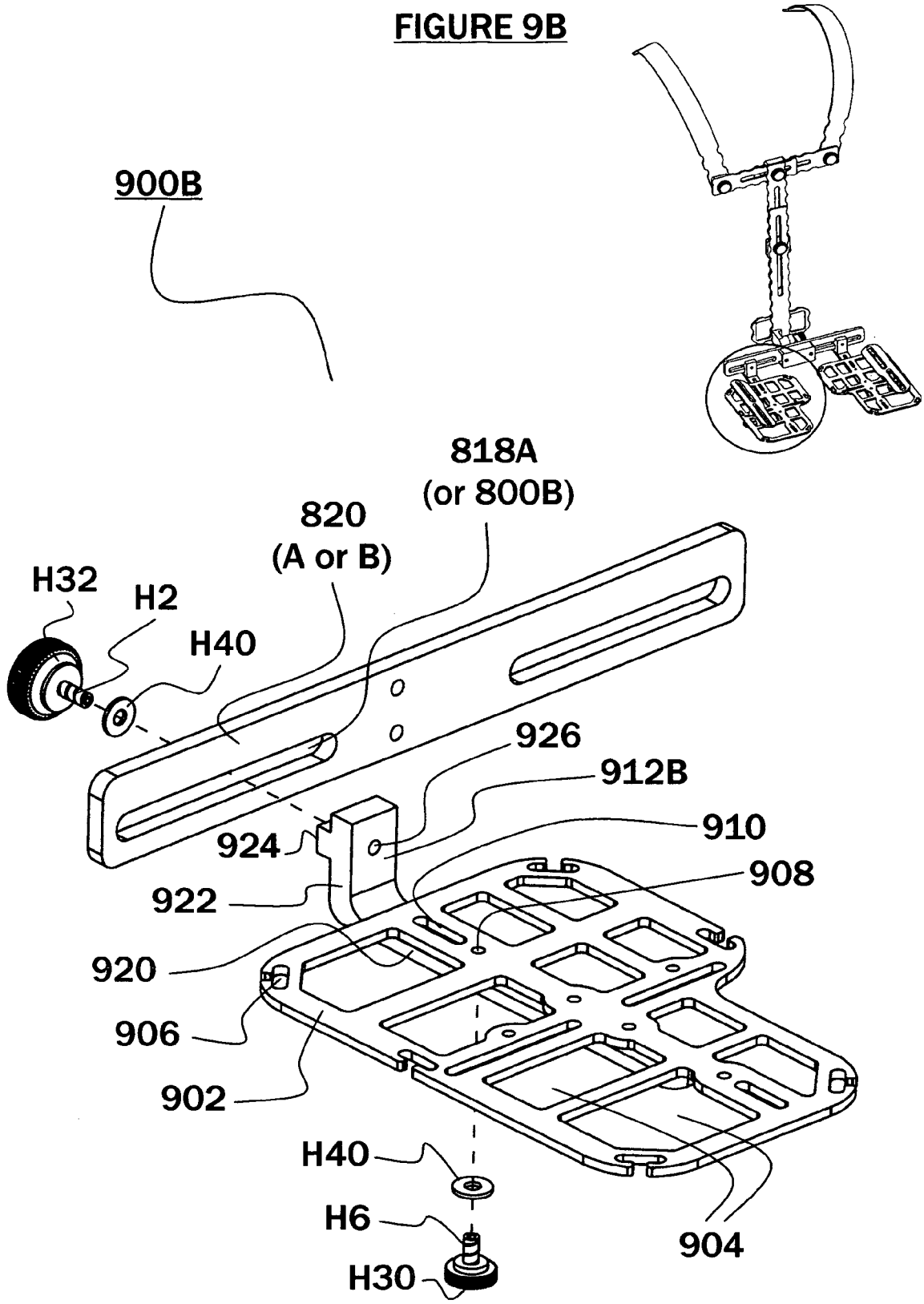
Figure 10A:
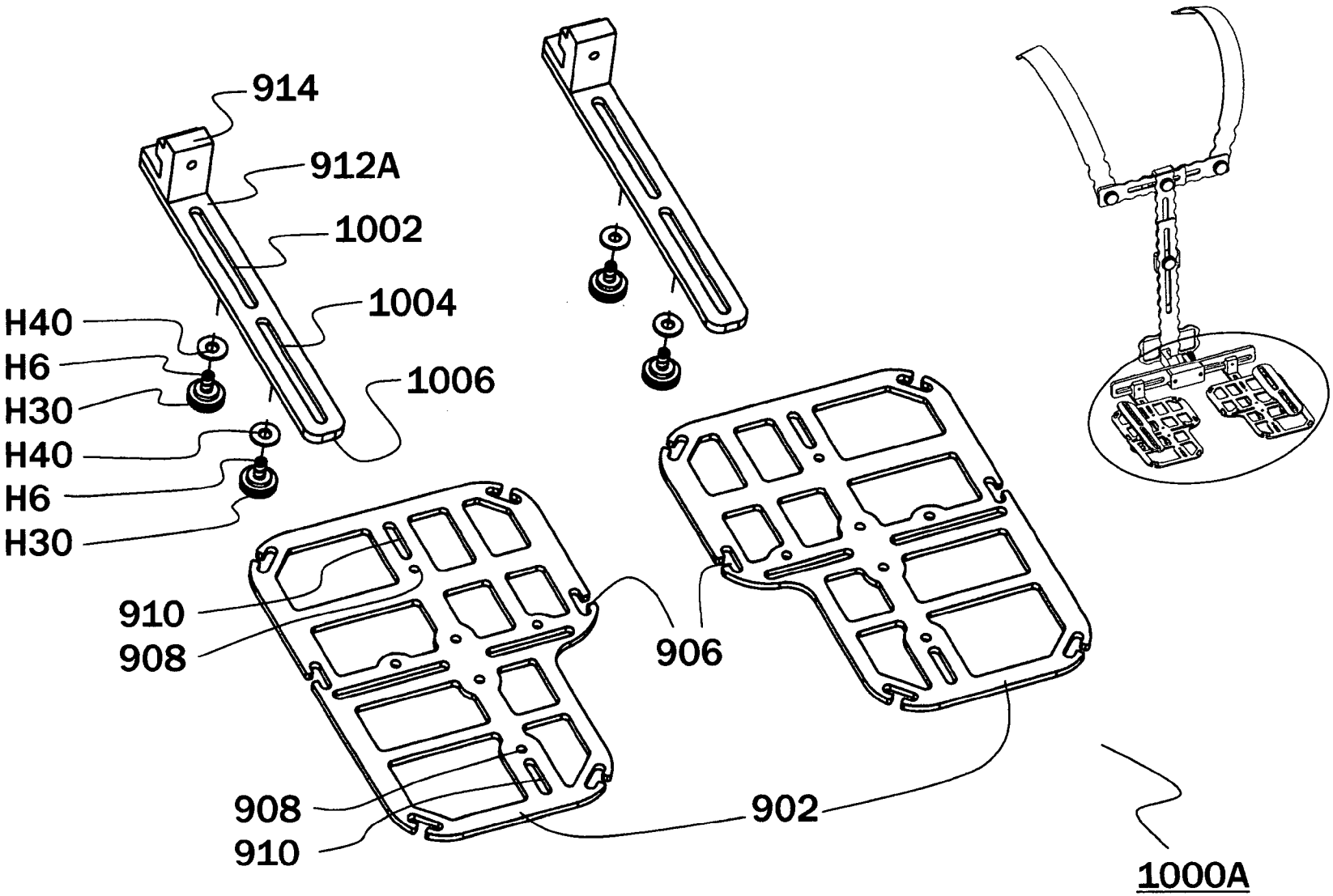
Figure 10B:
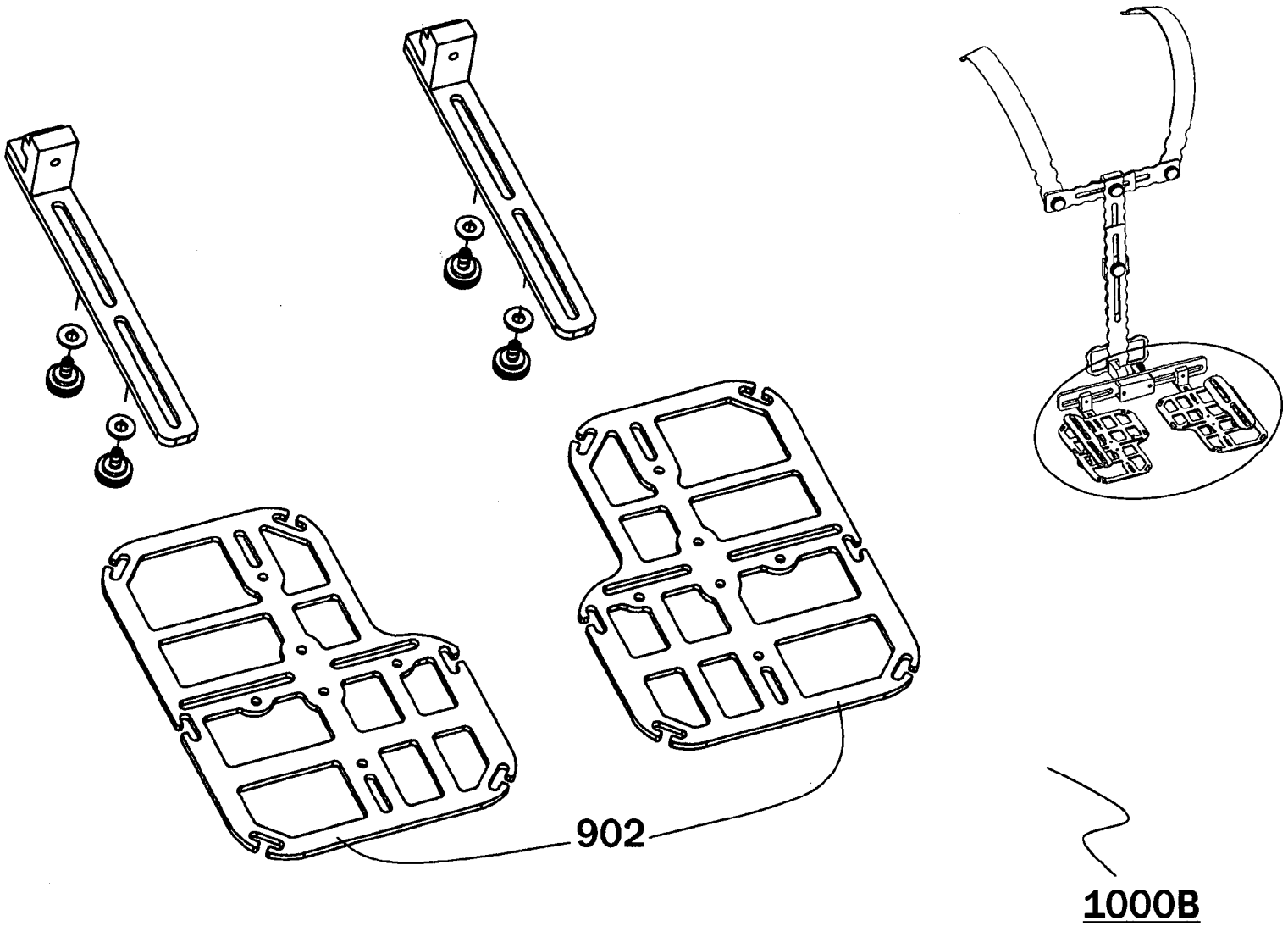
Figure 10C:
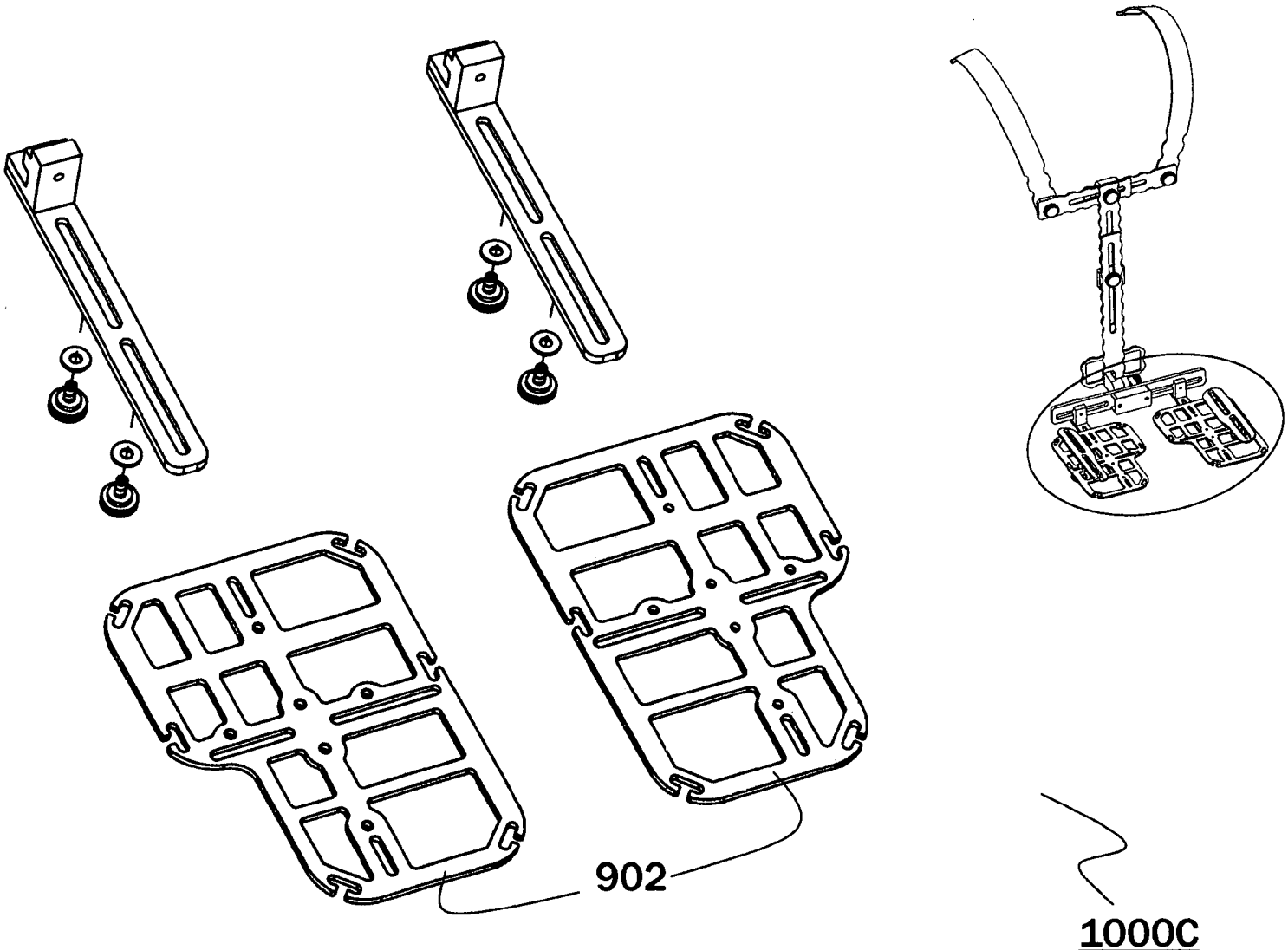
Figure 10D:
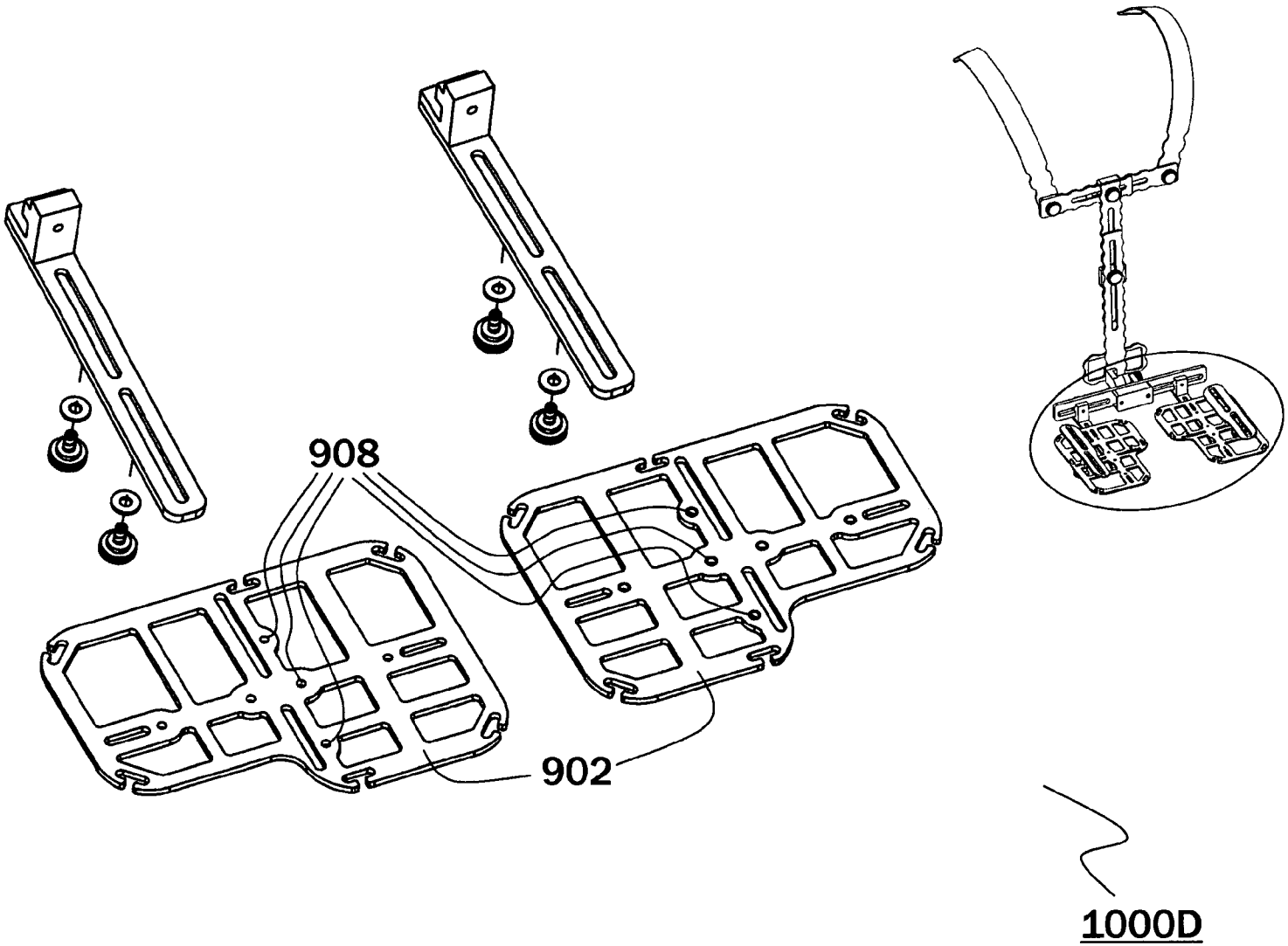
Figures 11A, 11B:
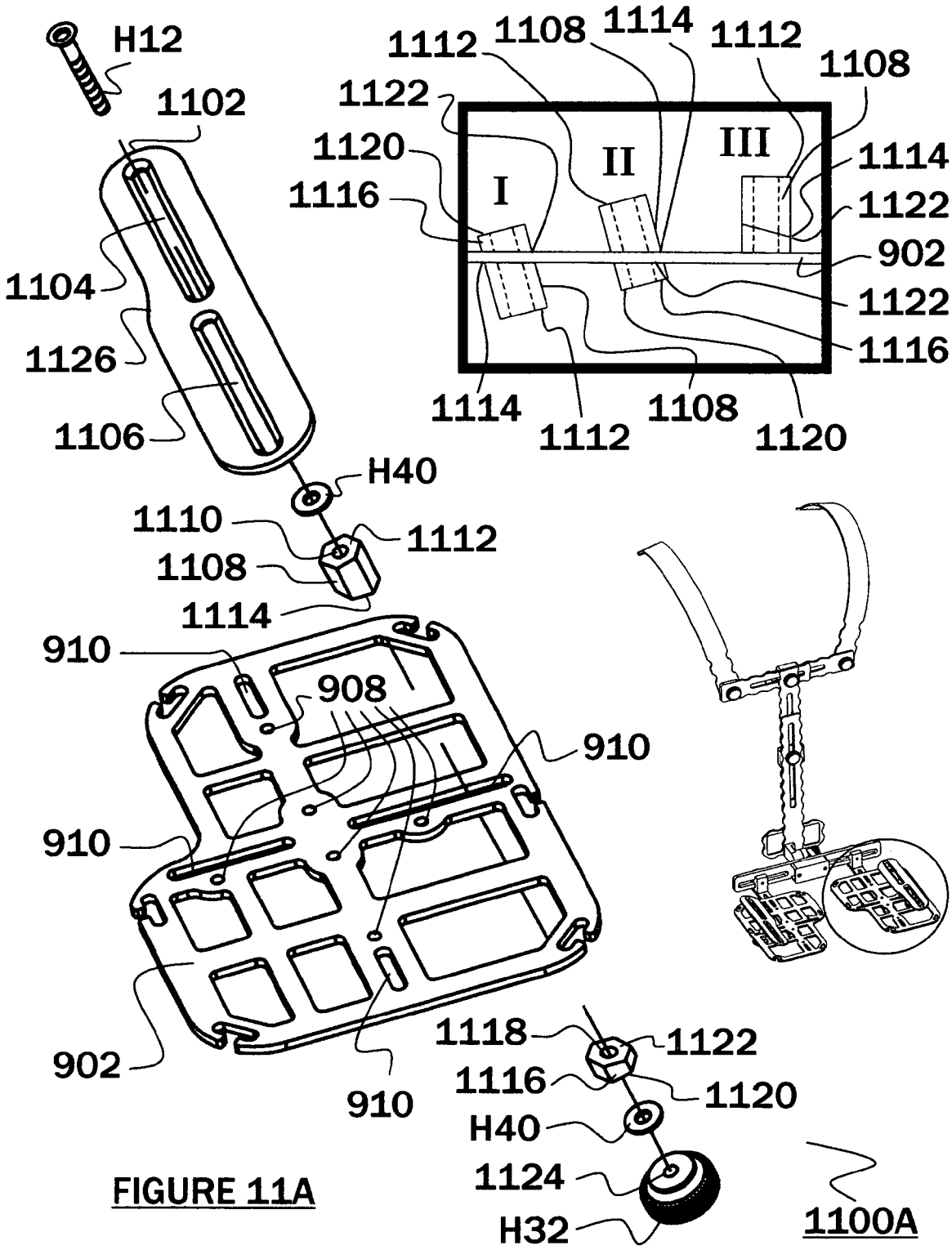
Figure 12A:
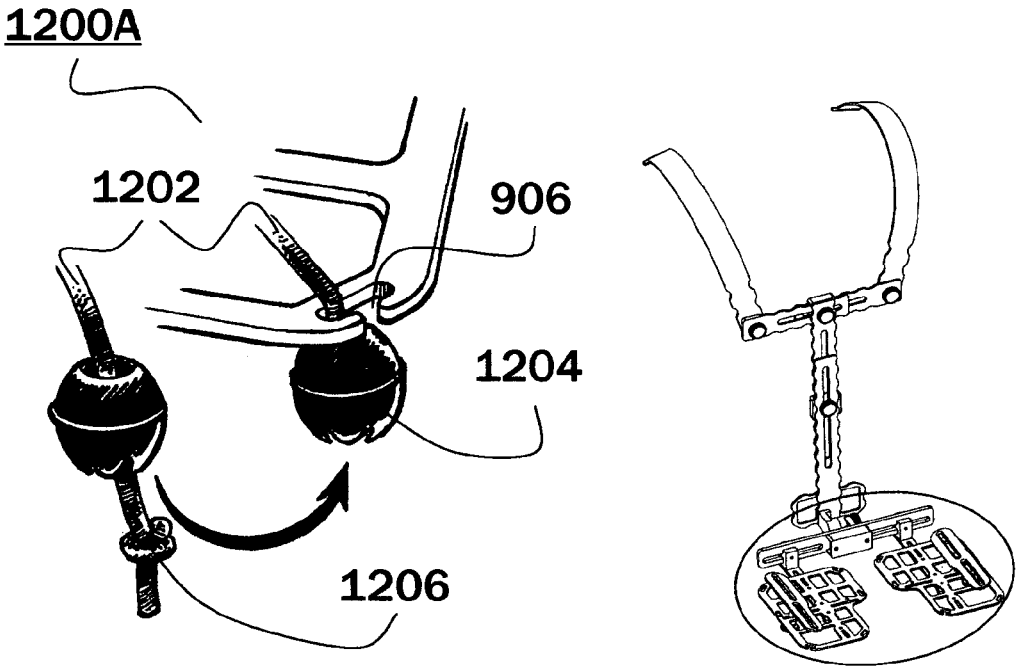
Figure 12B:
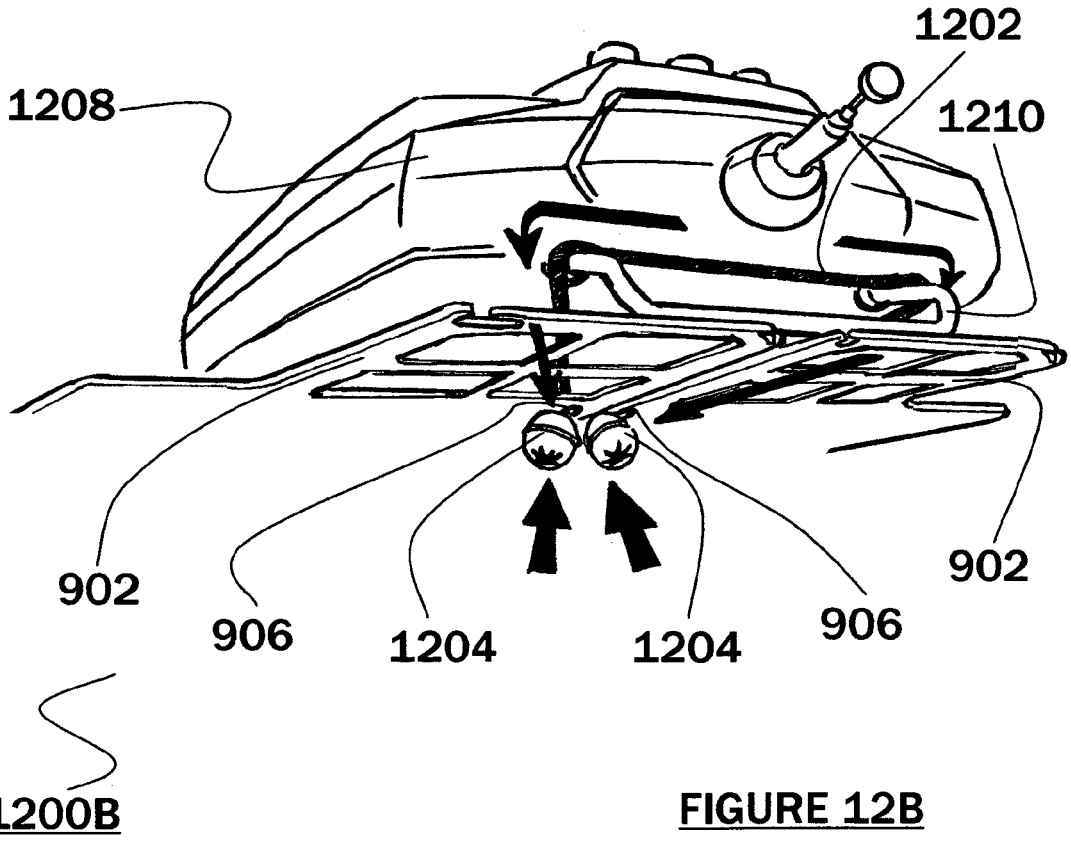
Figure 13:
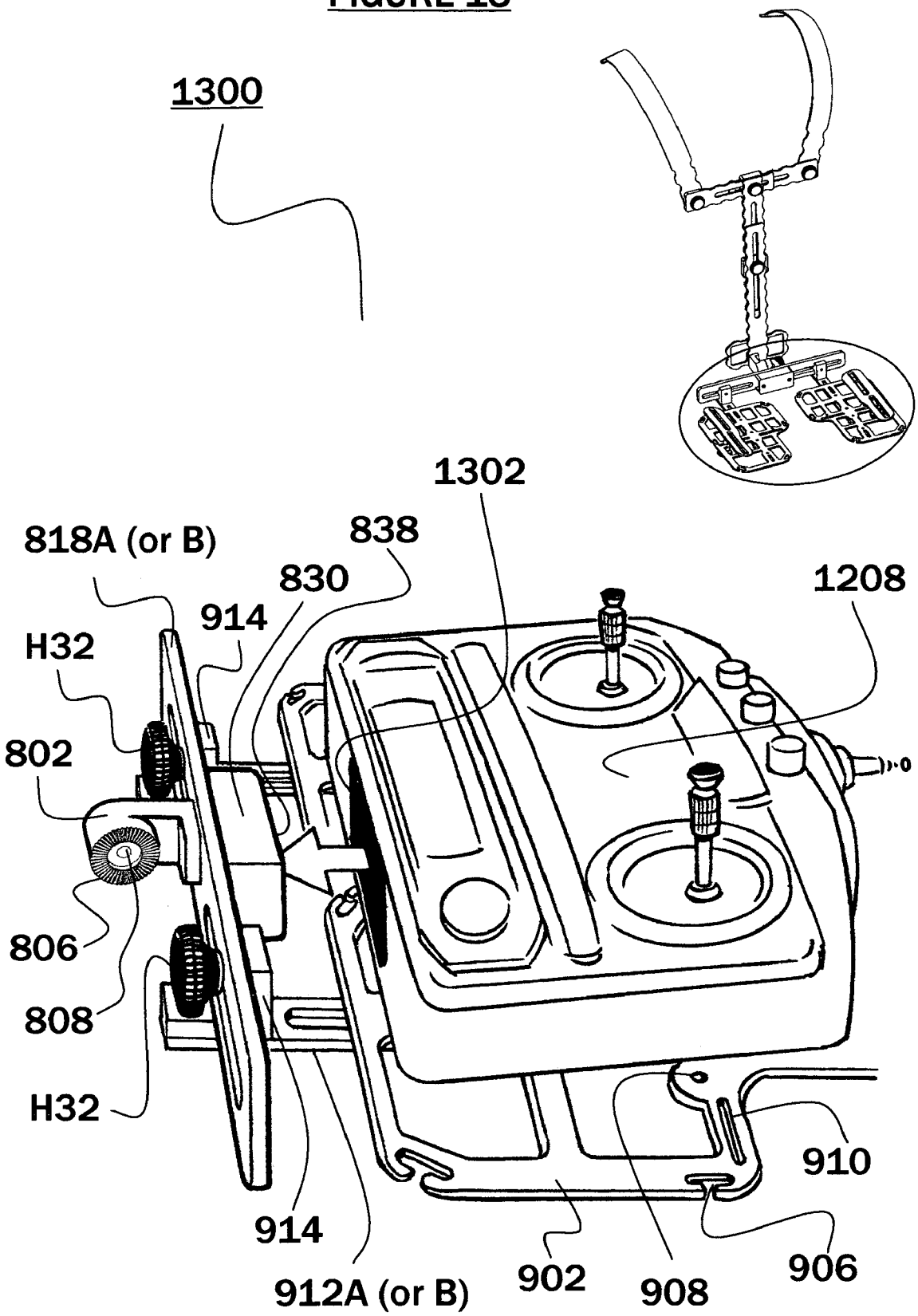
Figure 14A:
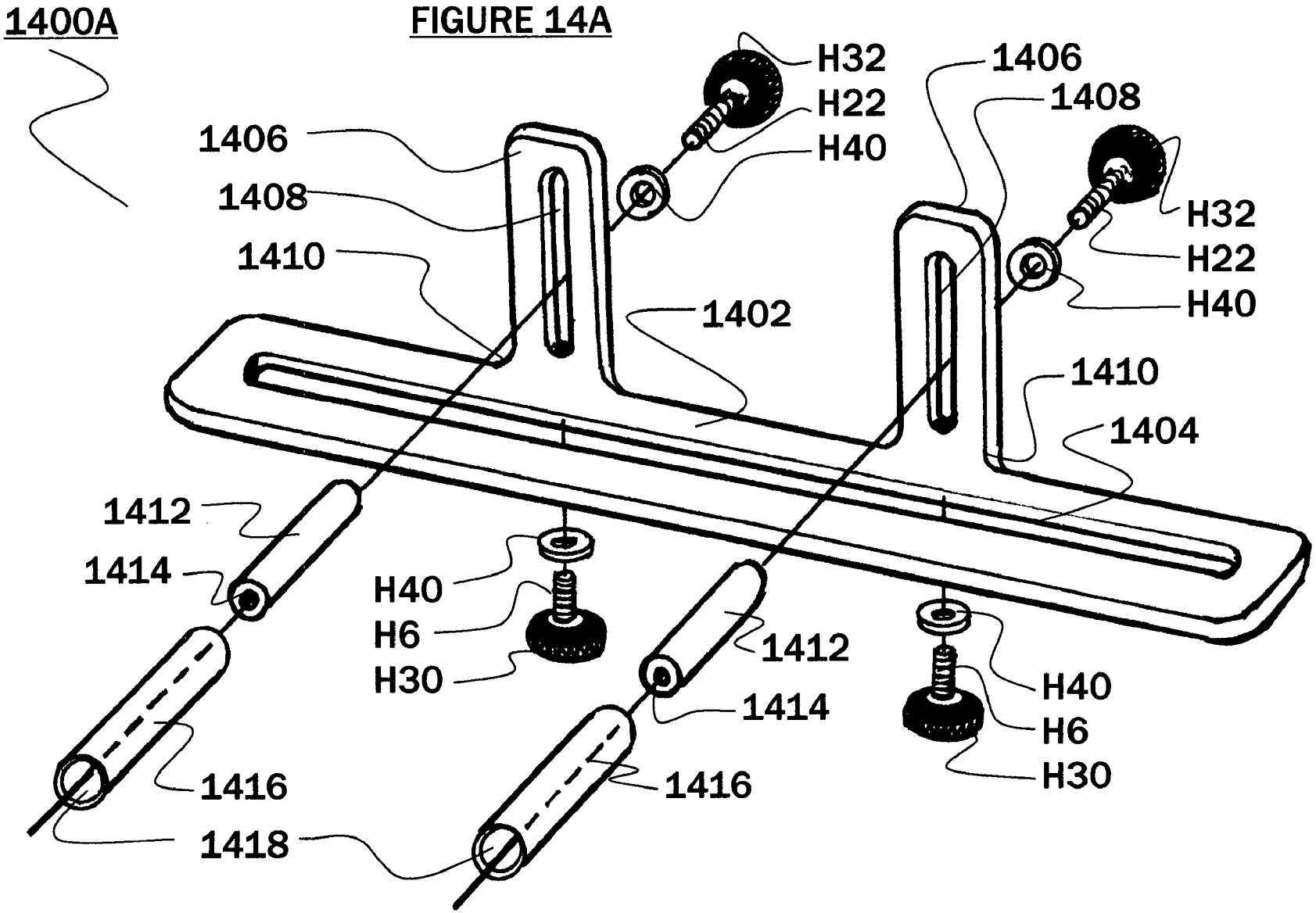
Figure 14B:
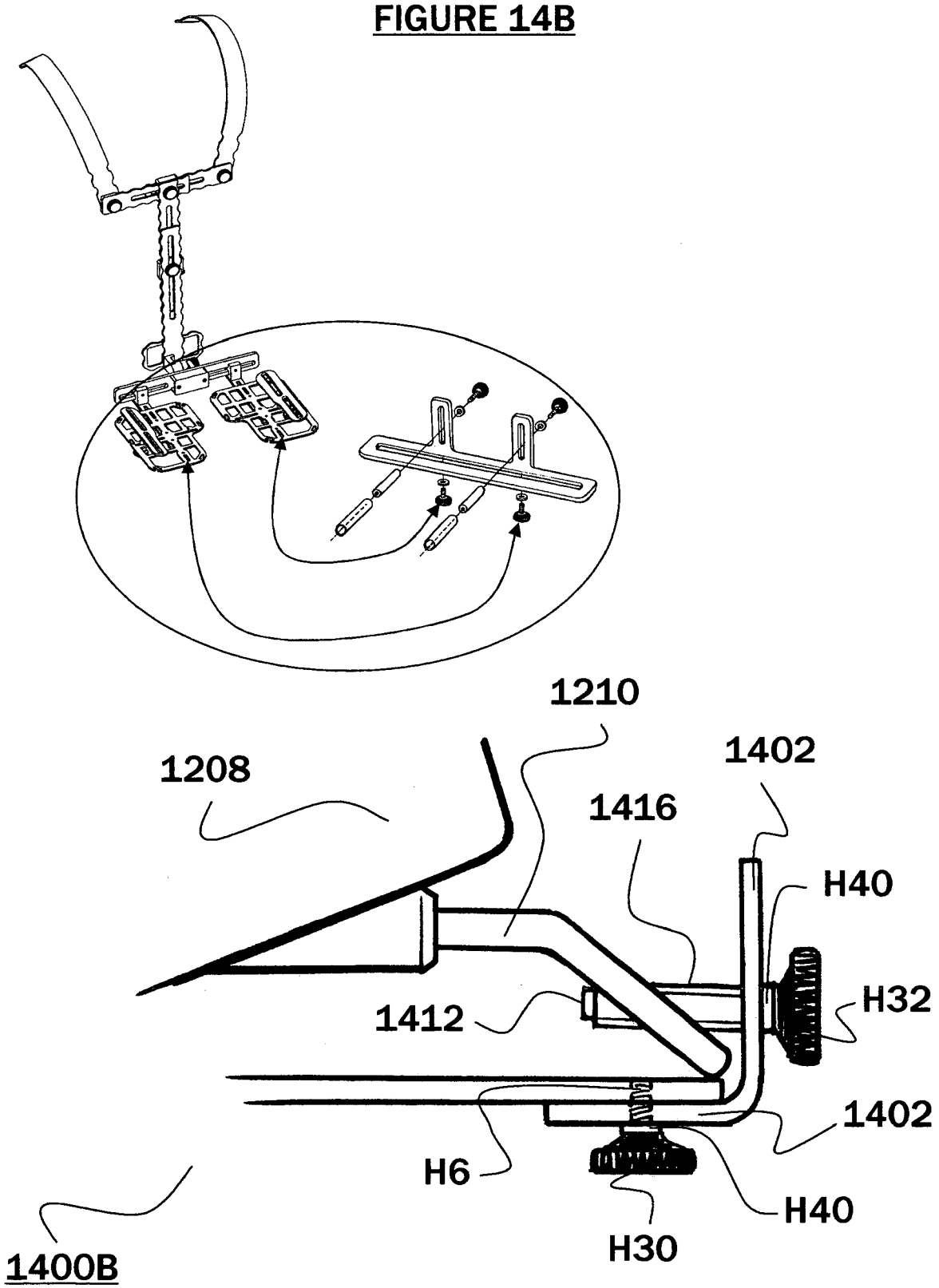
Figure 15:
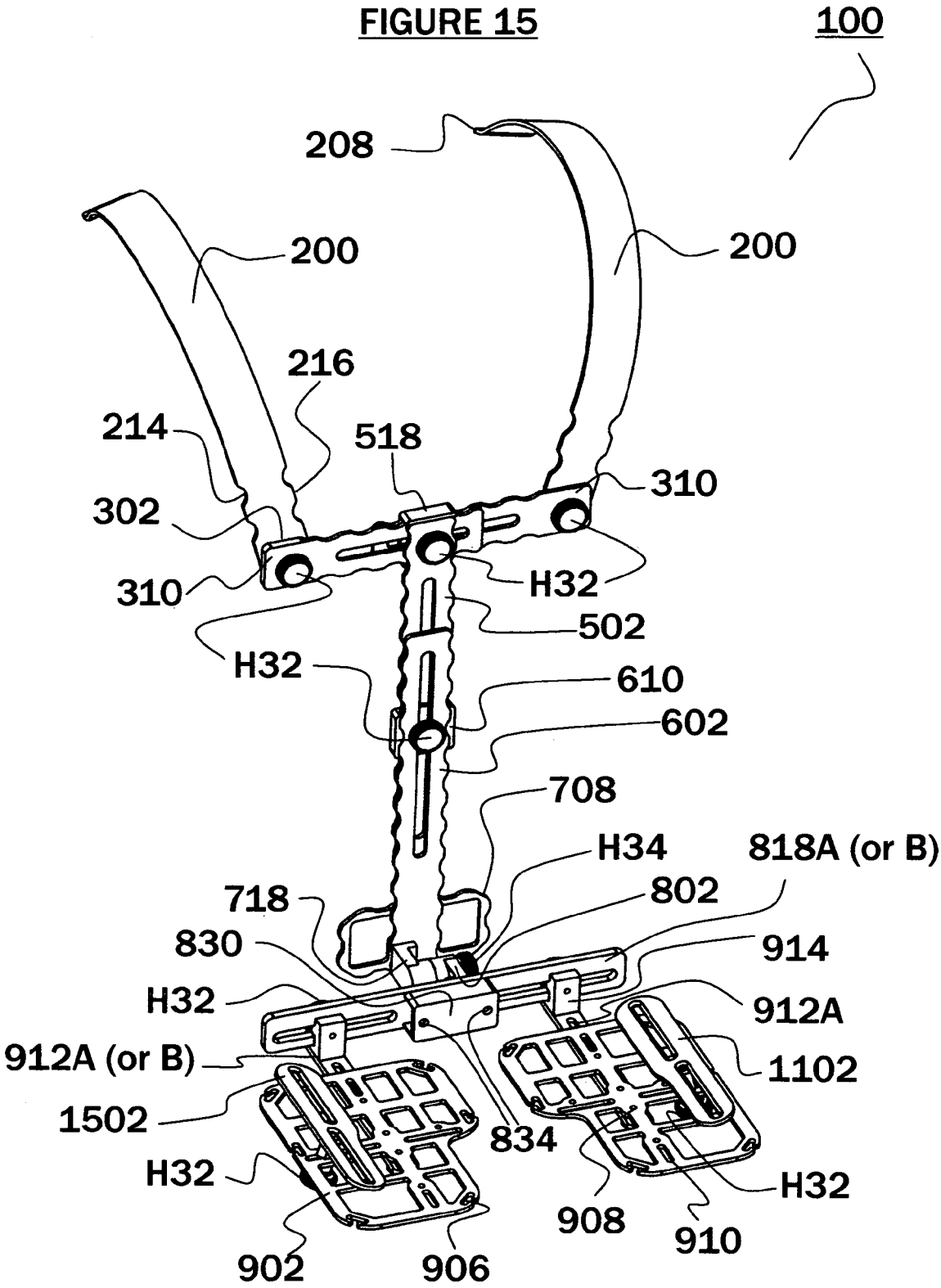

FIG. 5—An example of an upper chest crossbar/upper spine assembly with upper 'wave-grip' fastening system FIG. 6—An example of an upper/lower spine assembly with center 'wave-grip' fastening system FIG. 7—An example of a rear quick-lock/lower spine/twin loop belt buckle assembly FIG. 8A—An example of a front quick-lock/lower crossbar/Rip n'Grip™ block assembly FIG. 8B—A second example of a lower crossbar FIG. 8C—Blowup of the front quick-lock FIG. 9A—An example of a tray/tray spine/L-bracket/lower cross bar assembly FIG. 9B—An example of a tray/tray spine with L-bracket combination piece/lower cross bar assembly FIG. 10A—An example of a tray/tray spine/L-bracket assembly FIG. 10B—A second configuration of an example of a tray/tray spine/L-bracket assembly FIG. 10C—A third configuration of an example of a tray/tray spine/L-bracket assembly FIG. 10D—A fourth configuration of an example of a tray/tray spine/L-bracket assembly FIG. 11A—An example of a tray/tilt wrist rest assembly FIG. 11B—3 alternative hexagonal spacer configurations FIG. 12A—An example of a 'bungee bud' with bungee cord and end protector FIG. 12B—An example of an R/C transmitter utilizing the 'bungee bud' lockdown system FIG. 13—An example of an R/C transmitter with Rip n'Grip™ loop and hook fastening system FIG. 14*a*—An example of a hard lockdown assembly FIG. 14*b*—Side view of an example of a hard lockdown assembly locking down the front handle bar of an R/C transmitter FIG. 15—An example of an assembled wearable tray system

REFERENCE NUMERALS IN DRAWINGS

The reference numerals have been split into 2 categories. Numbers preceded by an 'H-' prefix have been used to designate common hardware items such as bolts, washers, knobs, etc which are well known in the art and easily describable in words and therefore do not require drawings. All other structural parts of the invention and their features have been labeled using numbers only.

All references to right and left are from the wearer's point of view. E.g. The right shoulder strap fits over the wearer's right shoulder while the left shoulder strap fits over the wearer's left shoulder.

H-2 Three quarter inch long all-thread Allen bolt

H-4 One half inch long all-thread Allen bolt

H-6 One half inch long hex head Allen bolt

H-8 One and one half inch hardened steel all-thread Allen bolt

H-10 One half inch long stainless steel flanged bolt with hex head insert

H-12 One and one quarter inch stainless steel flange bolt with hex head insert H-14 One and one quarter inch hardened steel flange bolt with hex head insert H-16 One half inch long one eighth inch diameter all-thread Allen bolt with hex head insert
H-18 One quarter inch long one eighth inch diameter all-thread Allen bolt with hex head insert
H-20 One inch long stainless steel flange bolt with hex head insert
H-22 One inch long Allen bolt
H-30 One half inch diameter press-fit plastic knob to fit 10/32 hex head
H-32 One inch diameter plastic knob with brass 10/32 tapped insert
H-34 One inch diameter knob of 6061 aluminum billet tapped with 10/32 thread
H-40 Five eighths inch outer diameter seven thirty-seconds inch inner diameter nylon washer to fit 10/32 thread bolt
100 Example of a wearable tray system on a wearer
200 Example of a shoulder strap
202 Rear end of shoulder strap
204 Front end of shoulder strap
206 Curve of shoulder strap
208 Bend near rear end of shoulder strap
210 Top 10/32 tapped hole near front end of shoulder strap
212 Bottom 10/32 tapped hole near front end of shoulder strap
214 Crescent cut into edge of shoulder strap
216 Straight segment between crescents on edge of shoulder strap
218 Bend points near front end of shoulder strap
220 Bend points near front end of shoulder strap
222 Bend points near front end of shoulder strap
224 Bend points near front end of shoulder strap
300 Example of a right shoulder strap/upper cross bar assembly
302 Rectangular spacer
304 Hole in center of rectangular spacer
306 45 degree arc pin guide in rectangular spacer
308 Edge of rectangular spacer
310 Upper chest crossbar piece
312 Hole in outside end of upper chest crossbar piece
314 45 degree arc pin guide in upper chest crossbar piece
316 Outside end of upper chest crossbar piece
318 Edge of upper chest crossbar piece
320 Inside end of upper chest crossbar piece
322 Slot in upper chest crossbar piece
324 Trough section of 'wave-grip' pattern
326 Straight segment section of 'wave-grip' pattern
400 Example of a left shoulder strap/upper cross bar assembly
500 Example of an upper chest crossbar/upper spine assembly
502 Upper spine
504 Slot in upper spine
506 Hole near upper end of upper spine
508 Upper end of upper spine
510 Lower end of upper spine
518 Upper 'wave-grip' fastening bracket
520 Center rectangular side of upper 'wave-grip' fastening bracket
522 Raised tapped hole in center of upper 'wave grip' fastening bracket
524 Upper side of upper 'wave grip' fastening bracket
526 Raised wave crest on inside of upper side of upper 'wave-grip' bracket
528 Lower side of upper 'wave grip' fastening bracket
530 Raised wave crest on inside of lower side of upper 'wave-grip' fastening bracket
532 Flat segment adjacent to raised wave crest on inside of upper side of upper 'wave-grip' fastening bracket
534 Flat segment adjacent to raised wave crest on inside of lower side of upper 'wave-grip' fastening bracket
600 Example of a center 'wave-grip' assembly
602 Lower spine
604 Slot in lower spine
606 Upper end of lower spine
608 Lower end of lower spine
610 Center 'wave-grip' fastening bracket
612 Center rectangular side of center 'wave-grip' fastening bracket
614 Adjacent side of center 'wave-grip' fastening bracket
616 Raised wave crest on inside of adjacent side of center 'wave-grip' fastening bracket
618 Flat segment adjacent to raised wave crest on inside of adjacent side of center 'wave-grip' fastening bracket
620 Raised slider on center 'wave-grip' fastening bracket
622 Tapped hole in slider on center 'wave-grip' fastening bracket
624 Rounded end of slider on center 'wave-grip' fastening bracket
626 Flat end of slider on center 'wave-grip' fastening bracket
628 Side of slider on center 'wave-grip' fastening bracket
630 Upper attachment hole through lower end of lower spine
632 Lower attachment hole through lower end of lower spine
700 Example of a rear quick-lock/lower spine/twin ring belt buckle assembly
708 Twin ring belt buckle
710 Opening through ring of belt buckle
712 Lower counter-sunk hole through belt buckle
714 Upper counter-sunk hole through belt buckle
716 Curved outside edge of belt buckle
718 Rear quick-lock
720 Gripping surface of rear quick-lock
722 Barrel of rear quick-lock
724 10/32 tapped spine attachment hole in rear quick-lock
726 Hollow in rear quick-lock
728 Main body of rear quick-lock
730 Attachment face of rear quick-lock
732 Ring of belt buckle
800A Example of a front quick-lock/lower crossbar/Rip n' Grip™ block assembly
800B Second example of a lower crossbar
800C Blowup of the front quick-lock
802 Front quick-lock
804 Barrel of front quick-lock
806 Gripping surface of front quick-lock
808 Hole in center of gripping surface of front quick-lock
810 Body of front quick-lock
812 10/32 tapped attachment hole in front of front quick-lock
814 Front surface of front quick-lock
816 Hollow in front quick-lock
818A Lower crossbar version 1
820A Slot in lower crossbar version 1
820B Slot in lower crossbar version 2
822A Upper attachment hole in lower crossbar version 1
822B Upper attachment hole in lower crossbar version 2
824A Lower attachment hole in lower crossbar version 1
824B Lower attachment hole in lower crossbar version 2
826 10/32 tapped Rip n' Grip block™ attachment hole
828 10/32 tapped Rip n' Grip™ block attachment hole
830 Rip n' Grip™ block
832 Front surface of Rip n' Grip™ block
834 Attachment hole in Rip n' Grip™ block
836 Side of Rip n' Grip™ block
838 Rip n' Grip hook™ pad
840 Alternate upper attachment hole in lower crossbar version 2

842 Alternate lower attachment hole in lower crossbar version 2
844 Rear bend in lower crossbar version 2
846 Front bend in lower crossbar version 2
848 Surface for Rip n' Grip™ on lower crossbar version 2
960A Example of a tray/tray spine/I-bracket/lower cross bar assembly
900B Example of a tray/tray spine with I-bracket combination piece/lower cross bar assembly
902 Tray
904 Opening through tray
906 'Bungee bud' in edge of tray
908 10/32 tapped attachment hole through tray
910 Slot in tray
912A Tray spine
912B Tray spine/L-bracket combination
914 L-bracket
916 10/32 tapped lower crossbar attachment hole in L-bracket
918 10/32 tapped spine attachment hole in L-bracket
920 Spine of spine/L-bracket combination
922 L-bracket of spine/L-bracket combination
924 Slider on spine/L-bracket combination
926 10/32 tapped knob attachment hole in spine/L-bracket combination
928 Slider on L-bracket
930 Counter-sunk L-bracket attachment holes in tray spine
932 Rear end of tray spine
1000A First configuration of an example of a tray/tray spine/L-bracket assembly
1000B Second configuration of an example of a tray/tray spine/L-bracket assembly
1000C Third configuration of an example of a tray/tray spine/L-bracket assembly
1000D Fourth configuration of an example of a tray/tray spine/L-bracket assembly
1002 Rear slot in tray spine
1004 Front slot in tray spine
1006 Front end of tray spine
1100A Example of a tray/tilt wrist rest assembly
1100B Three alternative hexagonal spacer configurations
1102 Left tilt wrist rest
1104 Wide end slot in wrist rest
1106 Narrow end slot in wrist rest
1108 Large hexagonal spacer
1110 Bolt hole through large hexagonal spacer
1112 Flat end of large hexagonal spacer
1114 Angle-cut end of large hexagonal spacer
1116 Small hexagonal spacer
1118 Bolt hole through small hexagonal spacer
1120 Flat end of small hexagonal spacer
1122 Angle cut end of small hexagonal spacer
1124 Tapped hole in H-32 knob
1126 Narrowing area of wrist rest
1200A Example of a 'bungee bud' with bungee cord and end protector
1200B Example of an R/C transmitter utilizing the 'bungee bud' lockdown system
1202 Bungee cord
1204 Bungee cord knot protector
1206 Knot in end of bungee cord
1208 R/C transmitter
1210 Carrying handle on R/C transmitter
1300 Example of an R/C transmitter with Rip n' Grip™ loop and hook fastening system
1302 Rip n' Grip™ self-adhesive loop pad
1400A Example of a hard lock down assembly
1400B Example of a hard lockdown assembly locking down the carrying handle of an R/C transmitter
1402 Hard lockdown bar
1404 Slot in body of hard lockdown bar
1406 Vertical arm of hard lockdown bar
1408 Slot in vertical arm of hard lockdown bar
1410 Bend at juncture of vertical arm and body of hard lockdown bar
1412 1" long 10/32 tapped all-threaded sleeve
1414 10/32 tapped hole through all-threaded sleeve
1416 1" long soft plastic surgical tubing sleeve guards
1418 Hole through sleeve guard
1420 Body of hard lockdown bar
1502 Right tilt wrist rest

SUMMARY OF THE INVENTION

The wearable tray system (100) was created to provide a work surface adjustable in many dimensions and aspects that is worn by the user. With the shoulder straps (200) placed over the shoulders, the tray(s) (902) extend from the midriff out in front of the body, providing a portable work and/or support surface. The basic structure of the wearable tray system comprises two shoulder straps (200) fastened to an upper crossbar (310) which is in turn fastened to a central spine (502/602) which extends down the front of the body. The central spine (502/602) is then connected to a lower crossbar piece (818A) which supports trays (902) in front of the body. The trays further have tilt wrist rests (1102,1502) attached to them for greater comfort and other functional possibilities.

The tray system (100) is adjustable in many dimensions. First, the shoulder straps (200) may be adjusted by bending at specific points to give a more precise fit and greater comfort to the wearer. The shoulder straps (200) also pivot out to the sides from vertical down to a 45° angle, again providing more options for greater comfort and usability.

The upper crossbar assembly (500), which comprises 2 upper crossbar pieces fastened together by the upper 'wave-grip' bracket (518), is adjustable in terms of width. The 2 upper crossbar pieces (310) and upper 'wave-grip' may be disassembled and reassembled to a number of configurations providing incremental length adjustment of the upper crossbar and therefore incremental width adjustment between the shoulder straps.

Similarly the central spine which comprises an upper spine piece (502), a lower spine piece (602) and the center 'wave-grip' fastening bracket (610), may also be disassembled from one another and reassembled in other configurations allowing for incremental adjustment of the length of the central spine and therefore of the height of the trays (902) in front of the wearer.

The quick-lock assembly (718/802) allows for pivoting of the lower crossbar with attached trays (902) down or up to any angle in front of the wearer. The trays may be slid out to the side or more towards the middle of the lower crossbar by loosening and sliding along the lower crossbar slots (820A) and then retightening. Further the trays may be pivoted out to the sides or detached from the tray spines (912A) and then reassembled in number of different configurations as desired.

Also the tilt wrist rests (1102,1502) may be adjusted in numerous ways: their placement on the tray (902) may be varied; their height above the tray (902) may be adjusted by removal and reconfiguration of the provided hexagonal spacers (1108, 1116): they may be attached underneath the trays (902) so as to function as 'feet' so that the wearable tray system (100) may be set safely on the ground; they may be positioned out to the sides of the trays (902) to serve as armature for attaching clamps or the like.

All of these adjustments may be made without the need for any external tools simply by tightening and loosening various knobs included in the system (100).

An important aspect of the wearable tray system is its inclusion of a technology named 'wave-grip' technology by the inventor. This technology allows for the secure lengthening or shortening of the upper crossbar as well as the central spine of the tray system (100) to provide some of the adjustability described above. This lengthening and shortening system, which provides a means of creating structural members of incrementally adjustable length, is a key feature which sets this invention apart from previous inventions.

This 'wave-grip' technology certainly has application in many areas, wherever the need arises for structural members whose length can be incrementally adjusted over and over as desired but which will firmly hold at any of numerous possible adjusted lengths. The 'wave-grip' generally comprises three pieces—two lengths of structural material with specially designed edges and a 'wave-grip' fastening bracket. The edges of the structural material are shaped into repetitions of a specially designed 'wave-grip' base pattern while the interior surfaces of the 'wave-grip' fastening bracket are shaped into a complementary pattern. When the structural pieces are arranged with one or more repetitions of the base patterns along the edges of the structural pieces properly aligned with one another, the 'wave-grip' fastening bracket may be engaged snugly into these aligned areas and tightened into position so as to form a solid structural member. The assembly may be disassembled and then reconfigured so as to form a structural member of any of numerous predetermined lengths. The assembly may be disengaged and securely reengaged over and over again at whatever allowable lengths are desired to suit current requirements or desires.

Further, special T-shaped inlets along the edges of the trays (902), named 'bungee buds' by the inventor, allow for bungee cords with special knot protectors to be employed to quickly fasten and unfasten items to and from the trays. Hook and loop technology is also provided as another means of removably securing items to the trays (902). Finally a hard lock-down system is provided to very securely fasten items such as radio transmitters to the trays (902).

The wearable tray system (100) has many potential applications, both inside and out of doors, in industry, Aero space, military, nautical, sports, entertainment, education, medicine, in camping and outdoor sports, with computers, in cinematography, and photography, as well as in innumerable other commercial and civilian private endeavors. The wearable tray system (100) can be used to support radio systems, digital televisions, radio control transmitters, as well as other audio and video equipment. The wearable tray system (100) can be used by artists working in the field or studio as a support system for the creation of artwork. It may be used for writing or to support books and other written materials while reading. The wearable tray system (100) has applications for musicians as a device to carry musical instruments and equipment. The wearable tray system (100) has applications for persons with disabilities and/or physical challenges. The wearable tray system (100) can serve anyone who requires a wearable, portable, completely adjustable, lightweight, tool-free workspace. The user of the embodiment of the wearable tray system described herein may be a youth or adult, man or woman. No special garments or clothing are required. This does not exclude the possibility of additional garments, pads, coverings or other accessories from being applied to assist with the use of the device.

DETAILED DESCRIPTION OF THE INVENTION

Parts and Fittings Needed to Assemble One Wearable Tray System:

(ALL THE FOLLOWING BOLTS HAVE 10/32 THREAD)

5 Three quarter inch long all-thread Allen bolts (H-2)

1 One half inch long all-thread Allen bolt (H-4)

4 One half inch long hex head Allen bolts (H-6)

1 One and one half inch hardened steel all-thread Allen bolt (H-8)

6 One half inch long stainless steel flanged bolt with hex head inserts (H-10)

2 One and one quarter inch stainless steel flange bolt with hex head insert (H-12)

2 One and one quarter inch hardened steel flange bolt with hex head inserts (H-14)

15 Five eighths inch outer diameter seven thirty-seconds inch inner diameter nylon washer to fit 10/32 thread bolt (H-40)

1 One half inch long one eighth inch diameter all-thread Allen bolt with hex head insert (H-16)

1 One quarter inch long one eighth inch diameter all-thread Allen bolt with hex head insert (H-18)

2 One inch long stainless steel flange bolt with hex head insert (H-20)

2 Three quarter inch long one half inch width hexagonal spacers that are cut on one end at a fifteen degree angle and fit 10/32 thread bolt (1108)

2 Three eighth inch long one half inch width hexagonal spacers that are cut on one end at a fifteen degree angle and fit 10/32 thread bolt (1116)

2 Shoulder straps (200)

1 Rectangular spacer—has 45 degree Allen bolt guide

NOTE: THIS PART HAS A 45 DEGREE ARC ALLEN BOLT GUIDE THAT MUST MATCH THE 45 DEGREE ARC MACHINED INTO THE RIGHT END OF THE UPPER CHEST CROSS BAR. (302)

2 Upper chest crossbar pieces (310)

1 Upper 'Wave-grip' fastening bracket (518)

1 Center 'Wave-grip' fastening bracket (610)

1 Upper spine (502)

1 Lower spine (602)

1 Rear quick lock (718)

1 Front quick lock (802)

1 Twin ring belt buckle (708)

1 Lower cross bar (818A)

1 Left tilt wrist rest (1102)

1 Right tilt wrist rest (1502)

2 Tray spine L-brackets (914)

2 Tray spines (912A)

4 One half inch diameter press-fit plastic knobs to fit 10/32 hex head (H-30)

8 One inch diameter plastic knobs with brass 10/32 tapped inserts (H-32)

1 One inch diameter knob of 6061 aluminum billet tapped with 10/32 thread (H-34)

2 Trays—with slots and 'bungee bud' patterns (902)

2 One foot long one eighth inch diameter bungee cords (1202)

4 One inch diameter plastic bungee cord knot protectors (1204)

1 Rip n' Grip™ block (830)

1 Rip n' Grip™ hook pad (838)

1 Rip n' Grip™ loop pad (1302)

Optional Hard Lockdown System Includes the Following Additional Parts: (H-30)

2 One half inch diameter press-fit plastic knob to fit 10/32 hex head (H-30)

2 One half inch long hex head Allen bolt (H-6)

2 One inch diameter plastic knob with brass 10/32 tapped insert (H-32)

2 One inch long Allen bolt (H-22)

4 Five eighths inch outer diameter seven thirty-seconds inch inner diameter nylon washer to fit 10/32 thread bolt (H-40)

2 1" long 10/32 tapped all-threaded sleeves (1412)

2 1" long soft plastic surgical tubing sleeve guards (1416)

1 Hard lockdown bar (1402)

Referring to FIG. 1, an example of an assembled wearable tray system (100) on a wearer is shown. The major structural components of this example of the wearable tray system are fabricated from 6061 aircraft quality aluminum. The 6061 aluminum has been machined, milled, and punched out on CNC equipment. 6061 aluminum has been chosen for this embodiment of the wearable tray system because of its light weight and excellent properties during anodizing as well as because aircraft quality aluminum is non-magnetic and inert to radio signals and transmissions. All custom machined parts for the device are anodized to military specs, level two. The tooling includes the use of a hydraulic brake and specialty jigs to facilitate the forming of the device's shoulder straps (200) that are key to the wearability of the tray system (100). This embodiment has been constructed primarily of 6061 aluminum, but the choice of 6061 aluminum is not meant to limit the scope of the invention any way as the device may be constructed of any suitable material(s).

Referring to FIGS. 2A-2C, an example of a shoulder strap (200) is shown. FIG. 2A shows a partial front view, FIG. 2B shows a side view and FIG. 2C shows an oblique view.

The shoulder strap (200) is made of a length of material. In the example, the shoulder straps have been fabricated from a strip of ⅛ inch thick 6061 aircraft quality aluminum approximately 15 inches long and one and one half inches wide. The shoulder strap (200) has a curve (206) along its length suited to rest over a person's shoulder.

The front end (204) of the shoulder strap (200) is designed to hang over the front a person's shoulder into the pectoral region where it attaches to the upper chest crossbar (310). There are two 10/32 tapped holes through the shoulder strap (200) near its front end (204), an upper hole (210) centered three quarters of an inch from the front end (204) and a lower hole (212) centered three eighths of an inch from the front end (204). In the region above these two holes (210) (212), beginning at one and seven eighths inches from the front end (204) of the shoulder strap (200), there are 2 crescents (214) with a straight segment (216) between them cut into each edge of the shoulder strap (200). The crescents (214) are three quarters of an inch wide and three sixteenths of an inch deep and the straight segments (216) are five eighths of an inch long. This crescent (214) and straight segment (216) pattern is designed to create bending points (218) (220) (222) (224) where the shoulder strap (200) may be bent to make further comfort adjustments. Bending at one or more of the bending points (218) (220) (222) (224), yields a sharper bend than bending at the center of the crescent (214).

The rear end of each shoulder strap (202) is designed to hang over the back of the shoulder. The shoulder strap (200) has rounded edges and a small bend (208) away from the wearer's body one half inch away from the rear end (202) of the strap (200), to allow the rear end (202) of the shoulder strap (200) to slide over garments without catching any clothing as the wearable tray system (100) is being put on or taken off. In addition, should the wearer lift the tray/lower crossbar assembly (900 A or B) portion of the device away from the front of the body in an upwards arc in the course of normal motion, etc., this design substantially prevents the rear end (202) of the shoulder strap (200) from digging into the wearer's shoulder blade or back.

Referring to FIG. 3, an example of a right shoulder strap/upper cross bar assembly (300) is shown. In the example, the upper chest crossbar piece (310) is a length of one eighth inch thick 6061 aircraft quality aluminum approximately six and one half inches long and one and one half inches wide. Near the outside end (316) of the upper chest crossbar piece (310), there is a seven thirty-seconds inches diameter untapped shoulder strap attachment hole (312) centered approximately three quarters of an inch from the outside end (316) and a seven thirty-seconds inch wide 45 degree arc pin guide (314) placed just below the attachment hole (312) and just towards the inside end (320) of the upper chest crossbar piece (310) centered three eighths of an inch away from the shoulder strap attachment hole (312), the center of said arc being located at the center of the shoulder strap attachment hole (312).

The upper chest crossbar piece (310) has a three eighths inch wide slot (322) with rounded ends cut through its center along most of its length. The slot (322) extends from two and one eighths inches from the outside end (316) of the crossbar piece (310) up until three eighths of an inch from the inside end (320) of the upper chest crossbar piece (310). Starting at one and one half inches form the outside end (316), the long edges (318) of the upper chest crossbar piece (310) have a wave-grip pattern (324,326) along almost their entire length. The pattern is an alternation between five eighths inch long, one eighth inch deep wave troughs (324) and three eighths inch long straight segments (326).

A rectangular spacer (302) of one eighth inch thick 6061 aircraft quality aluminum is interposed between right upper chest crossbar piece (310) and the right shoulder strap (200). The rectangular spacer (302) measures one and one quarter inches wide by one and a half inches high from top to bottom. There is a single five thirty-seconds inches diameter untapped attachment hole (304) through the spacer (302) centered at three quarters of an inch from the outside end of the spacer (302) and midway between the top and bottom of the spacer (302). There is also a one eighth inch wide 45 degree arc pin guide (306) centered on the attachment hole (304) and centered three eighths of an inch away from the attachment hole (304). One end of the pin guide (306) is directly below the attachment hole (304) and the arc extends up and towards the inside end from there.

The right shoulder strap (200) is bolted to the right upper chest crossbar piece (310) by a plastic knob (H-32) fitted with a brass insert tapped to A 10/32 thread into which A three quarter inch long all thread hex head Allen bolt (H-2) has been inserted and secured with red Permatex® Thread Locker. A nylon washer (H-40) is slipped over the knob's (H-32) Allen bolt (H-2) prior to assembly. With the 45 degree arc pin guide (306) in the rectangular spacer (302) aligned with the 45 degree arc pin guide (314) in the upper chest crossbar piece (310), The knob's (H-32) Allen bolt (H-2) inserted first through the untapped hole through the outside end (312) of the upper crossbar piece (310) then through the hole (304) in the rectangular spacer (302) then through the upper 10/32 tapped hole (210) through the front end (204) of the shoulder strap. The purpose of the nylon washer (H-40) is to provide relief, so that no matter how firmly the knobs (H-32) are tightened by hand, they will not bind in place and can be loosened by hand.

A one half inch long one eighth inch diameter all-thread Allen bolt with hex head insert (H-16) is inserted from the rear through the lower 10/32 tapped hole (212) near the front end (204) of the right shoulder strap (200) and through the 45 degree arc pin guide (306) in the rectangular spacer (302) and into the 45 degree arc pin guide (314) in upper chest crossbar piece (310). By tightening the knob (H-32), the shoulder strap (200) is secured in position. By loosening the knob (H-32), the shoulder strap (200) is released so it can pivot within the range limit defined by the 45 degree arc pin guides (306) (314) and the bolt (H-16) riding in them.

Referring to FIG. 4, an example of a left shoulder strap/upper cross bar assembly (400) is shown. This assembly is the same as the right side assembly (300) above except that there is no rectangular spacer (302) on the left side and the bolts (H-18, H-4) are therefore shorter. The left shoulder strap (200) is bolted to its respective upper chest crossbar piece (310) by a plastic knob (H-32) fitted with a brass insert tapped to A 10/32 thread into which a one half inch long all-thread Allen bolt (H-4) has been inserted and secured with red Permatex® Thread Locker. A nylon washer (H-40) is slipped over the knob's (H-32) Allen bolt (H-4) before insertion through untapped hole (312) in the outside end (316) of the upper chest crossbar piece (310) then into the upper 10/32 tapped hole (210) in the front end (204) Of the left shoulder strap (200). A one quarter inch long one eighth inch diameter all-thread Allen bolt with hex head insert (H-18) is inserted from the rear through the lower 10/32 tapped hole (212) near the front end (204) of the left shoulder strap (200) and into the 45 degree arc pin guide (314) in upper chest crossbar piece (310).

Referring to FIG. 5, an example of an upper chest crossbar/upper spine assembly (500) is shown. The upper spine (502) is a length of one eighth inch thick 6061 aircraft quality aluminum twelve inches long and one and one half inches wide. There is a seven thirty-seconds inches diameter untapped upper chest crossbar attachment hole (506) centered three quarters of an inch from the upper end (508) of the upper spine (502). The upper spine (502) has a three eighths inch wide slot (504) with rounded ends cut through its center along most of its length. The slot (504) extends from four inches from the upper end (508) of the upper spine (502) down to one half inch from the lower end (608) of the upper spine (502). The long edges of the upper spine (502) have a 'wave-grip' pattern along almost their entire length. The pattern is the same as the 'wave-grip' pattern given above; alternating wave troughs (324) and straight segments (326).

The upper 'wave-grip' fastening bracket (518) is made of 6061 aluminum and has a 3-sided structure. It has a center rectangular side (520) with a raised 10/32 tapped hole (522) in its center. This rectangular side (520) measures one and three quarters inches high by one and one half inches wide and is one eighth inch thick. The other two sides, the upper side (524) and the lower side (528), of the upper wave grip fastening bracket (518) extend at 90 degrees from the center square side (520) in the same direction as the raised tapped hole (522). The upper side (524 of the upper 'wave-grip' fastening bracket (518) measures one half inch by one and one half inches and is one eighth inch thick.

There is a convex raised wave crest (526) five eighths of an inch long and one eighth of an inch high on the inside of the upper side (524) of upper 'wave-grip' bracket (518). The lower side (528) of the upper 'wave-grip' fastening bracket (518) measures three eighths of an inch by one and one half inches and is one eighth of an inch thick. There is a convex raised wave crest (530) five eighths of an inch long and one eighth of an inch high on the inside of the lower side (528) of the upper 'wave-grip' bracket (518). These convex wave crests (526) (530) complement the wave troughs (324) in the 'wave-grip' pattern along the edges of the upper chest crossbar pieces (310). These crests (526) (530) and troughs (324) will interlock to form a non-slipping joint when the upper 'wave-grip' fastening bracket (518) is engaged with the upper chest crossbar pieces (310).

Adjacent on either side to the raised crest (526) on the upper side (524) of the upper 'wave-grip' fastening bracket (518) are flat segments (532) seven sixteenths of an inch long. Likewise, adjacent on either side to the raised crest (530) on the lower side (528) of the upper 'wave-grip' fastening bracket (518) are flat segments (534) seven sixteenths of an inch long. These flat segments (532) (534) are designed to abut the flat segments (326) of the wave-grip pattern on the upper chest crossbar pieces (310) when the upper 'wave-grip' fastening bracket (518) is engaged with the upper chest crossbar pieces (310).

The right (310) and left (310) upper chest crossbar pieces are identical to one another. One is simply flipped in space relative to the other for assembly. To assemble the 2 upper chest crossbar pieces (310) and the upper spine (502) together using the upper 'wave-grip' fastening bracket (518), a one inch diameter plastic knob with brass 10/32 tapped insert (H-32) with a three quarter inch long all-thread Allen bolt (H-2) inserted is utilized. First a washer (H-40) is placed upon the three quarter inch long all-thread Allen bolt (H-2) and then the bolt (H-20) is inserted through the untapped attachment hole (506) in the upper end (508) of the upper spine (502) then through the slot (322) in the right upper chest crossbar (310) then through the slot (322) in the left upper chest crossbar (310) and into the 10/32 tapped hole (522) in the upper wave-grip fastening bracket (518). A segment of the 'wave-grip' patterns of the 2 upper chest crossbars must be aligned so that they will fit together into the upper 'wave-grip' fastening bracket (518).

Further, the upper side (524) of the upper 'wave-grip' fastening bracket (518) is larger than the lower side (528) of the upper 'wave-grip' fastening bracket (518) and is designed so that the upper end (508) of the upper spine will abut the upper side (524) of the upper 'wave-grip' fastening bracket (518) in the assembled position, further stabilizing the assembly. The lower side (528) of the upper wave-grip fastening bracket (518) is made smaller so that its edge will lay flush with the surface of the right upper crossbar (310) when assembled. This allows a complete tightening down of the upper spine onto the 2 sandwiched upper crossbar (310) pieces. The bolt (H-2) is tightened down using the knob (H-32) to secure the assembly (500) or loosened to disassemble for reconfiguration.

One of the innovations of the present invention is that it introduces and utilizes 'wave-grip' technology. Illustrations of 2 examples of wave-grip fastening systems can be seen in FIGS. 5, 6 and 15. 'Wave-grip' technology allows two separate pieces of material of any length to be joined by one or more 'wave-grip' fastening brackets. The fastening bracket(s) join two (or more) specially designed pieces together to create a single joined member. Each piece to be joined has edges shaped into a specifically designed 'wave-grip' pattern (324, 326). The 'wave-grip' fastening brackets (518,610) are specifically designed to interlock with the 'wave-grip' patterns (324,326) on the surfaces of the pieces to be joined. When the 'wave-grip' patterns (324,326) on the pieces to be joined are properly aligned, the 'wave-grip' fastening bracket(s) (518, 610) may be engaged creating a strong secure non-slipping 'wave lock' at that juncture.

An important and valuable feature of 'wave-grip' technology is that it provides a means to incrementally adjust the combined length of the joined pieces. The 'wave-grip' pattern is preferably a repeating pattern which allows for secure 'wave-grip' fastening bracket (518,610) engagement at a number of successive points along the lengths of the individual pieces to be joined. Thus by disengaging the fastening bracket(s) (518,610) and sliding the pieces into a new aligned position and reengaging the fastening bracket (518,610) in the new position, the combined length of the joined member can be adjusted. Only one single trough (324) with adjacent line segments (326) on each edge need be aligned with a corresponding section on a second similar piece in order to provide a location where the 'wave-grip' fastening bracket (518,610) can be engaged. An advantage of this system is that joined material may be quickly separated and rearranged into a new joined member with a different length over and over again without having to cut, saw or otherwise manipulate the actual two pieces of stock to be joined.

Further, the same technology can be used to vary the combined thickness of the joined member along all or part of its length. by stacking in proper alignment two or more compatible 'wave-grip' patterned pieces of material and engaging the 'wave-grip' fastening bracket(s) (518,610), a joined member with any of various combined thicknesses may be created. This technology is extremely versatile and can certainly be useful in innumerable various fields of endeavor. Applications for 'wave-grip' technology are available in a multitude of situations where two or more lengths of material are to be securely but incrementally adjustably joined as one. 'Wave-grip' technology clearly has many possible applications in such arenas as scaffolding, temporary fencing, stadium railing, sports equipment, medical equipment, home furnishings, industrial applications, lighting, interior design, engineering, military, construction, automotive, aero-space technology, and so forth.

The design of the 'wave-grip' pattern with its compatible fastening brackets may be varied in many parameters and still produce a functioning fastening assembly. Certainly some designs have advantages over others. In the examples of 'wave-grip' technology given in the example of the wearable tray system (100) included herein, the 'wave-grip' pattern along the edges of the joinable pieces consists essentially of alternating straight segments (326) and concave wave troughs (324). The surfaces of the 'wave-grip' fastening bracket(s) (518,610) have a shape complementary to the 'wave-grip' pattern on the joinable pieces, in cross-section this shape appearing as a convex crescent (or wave crest) (526,530,616) sandwiched between two short straight segments (532,534, 618). The surfaces of the fastening bracket(s) (518,610) are thus designed to interlock with the 'wave-grip' patterns on 2 or more joinable pieces simultaneously, creating a non-slipping juncture once fastened.

In other embodiments, the design of the 'wave-grip' pattern can be varied in many parameters and still produce a functional 'wave-grip' mechanism. For example, the amplitude, wavelength and or shape of the 'waves' that constitute the repeated base pattern which make up the wave-grip pattern can be adjusted in innumerable ways to suit any given application. The alternating wave trough (324)/line segment (326) pattern given as an example is not meant to limit the scope of the invention in any way. Functional 'wave-grip' fastening systems can be made in any size and using any of innumerable 'wave-grip' patterns.

In the given examples of 'wave-grip' technology, A removable bolt (H-2) with knob (H-32) secures the 'wave-grip' fastening bracket (518,610) and separate lengths (310,502, 602) of material together. The bolt (H-2) penetrates through holes or slots in the joinable lengths of material and tightens into the threaded tapped hole (522,622) provided for it in the 'wave-grip' fastening bracket (518,610). The 'wave-grip' fastening bracket (518,610) wraps around the joinable length of material on 3 sides (1 face and 2 edges), its convex surfaces (526,530,616) interlocking with the concave 'wave-grip' pattern (324,326) in the edges of the joinable materials, thereby preventing either length of material from slipping out of alignment once the assembly is fastened together with the bolt (H-2). in this example, A knob (H-32) made integral to the head of the bolt (H-2) is provided for quick and easy tool-less assembly and disassembly of the 'wave-grips' in order to adjust the various dimensions of the wearable tray system (100). In other embodiments of the 'wave-grip' fastening system, tools may be preferred or required for the assembly and disassembly of the 'wave-grip' depending upon the design, size, purpose, etc. of the 'wave-grip' fastener.

In the example of the upper 'wave-grip' assembly (500) outlined above, a third piece of material, the upper spine (502), is incorporated into the joint. It is not held in place by a true 'wave-grip' but rather only by the tightened single knob/bolt (H-32)/(H-2) assembly and the abutment of its upper end (508) against the larger upper side of the upper wave-grip fastening bracket (518).

Referring to FIG. 6, an example of a center wave-grip assembly (600) is shown. The center 'wave-grip' fastens the upper spine (502) to the lower spine (602). The lower spine (602) is a length of one eighth inch thick 6061 aircraft quality aluminum twelve inches long and one and one half inches wide. There are 2 seven thirty-seconds inches diameter untapped belt buckle/rear quick lock attachment holes (630) (632) located near the lower end (608) of the lower spine (602). The upper untapped attachment hole (630) is centered three sixteenths inches and from the lower end (608) of the lower spine (602) and seven sixteenths inches from the side of the lower spine (602). The lower untapped attachment hole (632) is located nine sixteenths inches from the lower end (608) of the lower spine (602) and seven sixteenths inches from the side of the lower spine (602) directly below the upper attachment hole (630).

The lower spine (602) has a three eighths inch wide slot (604) with rounded ends cut through its center along most of its length. The slot (604) extends from one half inch from the upper end (506) of the lower spine (602) down to four inches from the lower end (608) of the lower spine (602). The long edges of the lower spine (602) have a 'wave-grip' pattern (324,326) along almost their entire length. The pattern is the same as the 'wave-grip' pattern given above; alternating wave troughs (324) and straight segments (326).

The center 'wave-grip' fastening bracket (610) is similar to the upper wave-grip fastening bracket (518) above. In this case however the two sides (614) of the bracket adjacent to the center rectangular side (612) are identical to one another. There is a convex raised wave crest (616) five eighths of an inch long and one eighth of an inch high on the inside of each adjacent side (614) of the center 'wave-grip' fastening bracket (610). These convex wave crests (616) complement the wave troughs (324) in the 'wave-grip' pattern along the edges of the upper spine (502) and lower spine (602). These crests (616) and troughs (510) will interlock to form a non-slipping joint when the center 'wave-grip' fastening bracket (610) is engaged with the two spine pieces (502) (602).

Adjacent on either side to the raised crests (616) on the adjacent sides (614) of the center 'wave-grip' fastening bracket (610) are flat segments (618) seven sixteenths of an inch long. These flat segments (618) are designed to abut the flat segments (326) of the 'wave-grip' pattern on the upper spine (502) and lower spine (602) when the center 'wave-grip' fastening bracket (518) is engaged with the upper spine (502) and lower spine (602).

The center rectangular side (612) of the center 'wave-grip' fastening bracket (610) measures one and a half inches by one and three quarters inches and is one eighth of an inch thick. The adjacent sides (614) of the center 'wave-grip' fastening bracket (610) measure one and one half inches by three eighths inches and are one eighth of an inch thick.

This center 'wave-grip' fastening bracket (610) also differs from the upper wave-grip fastening bracket (518) above in that the center 'wave-grip' fastening bracket (610) has in the center of its center rectangular side (612) a raised slider (620) three eighths of an inch wide and fifteen sixteenths of an inch long that has flat sides (628), one rounded end (624) and one flat end (626). This slider (620) has a tapped 10/32 hole in its center (622). This slider (620) is designed to fit into the slots (504) (604) in the upper and lower spines (502) (602). The round end of the slider (624) is designed to fit into the rounded ends of the slots (504) (604) in the upper and lower spines (502) (602) when the slider (620) is arranged in the extreme positions in the slots (504) (604).

To assemble the upper spine (502) and lower spine (602) together using the center 'wave-grip' fastening bracket (610), a one inch diameter plastic knob with brass 10/32 tapped insert (H-32) with a three quarter inch long all-thread Allen bolt (H-2) inserted is utilized. First a washer (H-40) is placed upon the three quarter inch long all-thread Allen bolt (H-2) and then the bolt (H-2) is inserted through the slot (604) in the lower spine (602) then through the slot (504) in the upper spine (502) and into the tapped hole (626) in the center 'wave-grip' fastening bracket (610). The segment of the 'wave-grip' patterns of the upper spine (502) and lower spine (602) must be aligned so that they will fit together into the center 'wave-grip' fastening bracket (610). The bolt (H-2) is tightened down using the knob (H-32) to secure the assembly (600) or loosened to disassemble for reconfiguration.

As discussed above, this example of 'wave-grip' fastening technology allows the combined length of upper spine (502) and lower spine (602) to be easily incrementally adjusted to a number of different lengths and then firmly secured at any of those lengths without the need for any external tools. Tools may be required or desirable for assembly/disassembly of other embodiments of 'wave-grip' fastening technology.

Referring to FIG. 7, an example of a rear quick-lock/lower spine/twin ring belt buckle assembly (700) is shown. The twin ring belt buckle (708) is a is a flat piece of one eighth inch thick 6061 aircraft quality aluminum approximately four and one half inches long and two and three eighths inches wide. There are 2 L-shaped openings (710) made through the surface of the buckle (708). The belt buckle (708) serves 2 purposes. First, it distributes the weight of the wearable tray system (100) over a larger surface area on the wearer's midriff thus providing greater comfort. Second, it provides two rings (732) through which a belt or strap can be engaged in order to secure the wearable tray system (100) to the wearer if so desired.

The outside edges (716) of the buckle (708) are curved in a scalloped pattern as shown. This curved scalloped pattern (716) is designed to prevent any sharp metal edges from digging into a wearer's midriff. There are 2 seven thirty-seconds inches diameter counter-sunk lower spine attachment holes (712) (714) placed off-center in the central solid area of the buckle (708). These 2 counter-sunk holes (712) (714) are placed above one another off-center so they will align properly with the attachment holes (630) (632) near the lower end (608) of the lower spine (602) and the 2 attachment holes (724) in the rear quick-lock (718).

The rear quick lock (718) is one half of the locking mechanism which allows the tray assembly (900A or B) to pivot down at an angle to the ground or up away from the ground at an angle in front of the wearer and then be locked in the selected position. The rear quick lock (718) is a c-shaped structure, the body (728) Of the rear quick lock (718) being between the attachment face (730) and the barrel (722). There is a hollow (726) between the barrel (722) and the attachment face (730). The barrel contains the gripping face (720) which engages with the gripping face (806) of the front quick-lock (802). Out of the center of the gripping face (720) of the rear quick-lock (718), the threaded portion of a one and one half inch hardened steel all-thread Allen bolt (H-8) protrudes. This bolt (H-8) assembles through the untapped hole (808) in the gripping surface (806) of the front quick-lock (802) through a nylon washer (H-40) and engages with a one inch diameter knob of 6061 aluminum billet tapped with 10/32 thread (H-34).

To assemble the rear quick-lock (718) together with the lower spine (602) and belt buckle (708), two one half inch Long stainless steel flanged bolt with hex head insert (H-10) are inserted through the two counter-sunk attachment holes (712) (714) in the belt buckle, then through the 2 untapped attachment holes (630) (632) near the lower end (608) of the lower spine (602) and into the 2 10/32 tapped attachment holes (724) in the attachment surface (730) of the rear quick-lock (718) and tightened.

Referring to FIG. 8A, an example of a front quick-lock/lower crossbar/Rip n' Grip™ block assembly (800A) is shown. The front quick-lock (802) is nearly identical to the rear quick lock (718) except that rather than having a bolt (H-8) protruding from the center of its gripping surface (806), there is an untapped hole (808) through the center of the gripping surface (806) which penetrates all the way through the barrel (804) of the front quick-lock (802). Like the rear quick-lock (718), the front quick-lock (802) has a barrel (804) ending in a gripping surface (806), a body (810), and an attachment surface (814). The attachment surface (814) has two 10/32 tapped attachment holes (812) for attachment to the lower crossbar (818A) (818*b*).

The lower crossbar (818A) is a length of one quarter inch thick 6061 aircraft quality aluminum approximately ten and three quarters inches long and one and one quarter inches wide. There are 2 seven thirty-seconds inch diameter untapped front quick-lock attachment holes (822A) (824A), each centered approximately one quarter of an inch away from a side edge of the crossbar (818A), both one half inch in the same direction away from the midpoint of the length of the lower crossbar (818A) through the crossbar (818A). There are also 2 10/32 tapped Rip n' Grip™ block attachment holes (826) (828), one centered at four and one half inches from each end of the lower crossbar (818A) and in the middle of the width of the lower crossbar (818A). The lower crossbar (818A) has 2 three eighth inch wide slots (820A) with rounded ends cut through it. Each slot (820A) extends down the crossbar (818A) from one quarter of an inch from an end of the lower crossbar (818A) to four inches from that same end of the crossbar (818A). The slots (820A) are not centered as regards the width of the lower crossbar (818A) but are rather one quarter inch from one long edge of the crossbar (818A) but one half inch from the other long edge of the crossbar (818A).

The Rip n' Grip™ block (830) is so called because it provides a surface to which one of the 2 self-adhesive pads of a hook and loop pad fastening system can be applied.

Although Rip n' Grip™ has been utilized for the example, any hook and loop fastening system, such as Velcro™ T, can be used. The Rip n' Grip™ block (830) has a 3-sided structure, the front surface (832) being between the 2 sides (836) of the block (830) which extend backwards at 90 degrees from the front surface (832) of the block (830). The front surface (832) of the block (830) which measures two and one half inches long by one and one quarter inches wide, has 2 seven thirty-seconds inch diameter untapped counter-sunk attachment holes (834) centered in the middle of the width of the surface (832) and at one quarter inch from the ends of the block (830). The sides of the block (836) measure three quarters of an inch wide by two and one half inches long. The inside of the Rip n' Grip™ block (830) has been milled out to reduce the overall weight of the tray system (100).

The lower crossbar (818A) is assembled to the front quick-lock (802) by inserting 2 one half inch Long stainless steel flanged bolts with hex head inserts (H-10) through the 2 untapped attachment holes (822A) (824A) in the lower crossbar (818A) and into the 10/32 tapped attachment holes (812) in the attachment surface (814) of the front quick-lock (802). Once these bolts (H-10) are tightened down, the Rip n' Grip™ block (830) may be attached to the lower crossbar (818A)/front quick lock (802) assembly by inserting 2 one inch long stainless steel flange bolts with hex head inserts (h-20) through the attachment holes (834) in the Rip n' Grip™ block (830) and into the attachment holes (826) (828) in the lower crossbar (818A). A Rip n' Grip™ hook pad (838) is applied to the front surface (832) of the Rip n' Grip™ block (830) after the block (830) is tightly assembled to the lower crossbar (818A).

The rear quick-lock (718) and the front quick-lock (802) assemble together as described above.

Referring to FIG. 8B, a second example of a lower crossbar (800B) is shown. The second lower crossbar (800B) is a length of one quarter inch thick 6061 aircraft quality aluminum approximately ten and three quarter inches long and one and one quarter inches wide. There are 4 ten thirty-seconds of an inch diameter untapped front quick-lock attachment holes (822*b*) (824*b*) (840) (842), each centered approximately one quarter inch from an edge of the lower crossbar (800B) and four and seven eighths inches from an end of the lower crossbar (800B). The second lower crossbar (800*b*) has 2 three eighths inch wide slots (820*b*) with rounded ends cut through it. Each slot (820A) extends down the crossbar (800*b*) from one quarter of an inch from an end of the lower crossbar (800*b*) to four inches from that same end of the crossbar (800*b*). The slots (820*b*) are not centered as regards the width of the lower crossbar (800*b*) but are rather one quarter inch from one long edge of the crossbar (800*b*) but one half inch from the other long edge of the crossbar (800*b*).

This second example of a lower crossbar (800*b*) also has 4 approximately 45 degree angle bends (844) (846) along its length. There are 2 rear bends (844) and 2 front bends (846). The 2 rear bends (844) are located at four inches from the ends of the crossbar (800B) and the aluminum bends forward at these two locations. The 2 front bends (846) are located at approximately five and one eighth inches from the ends of the crossbar (800*b*) and the aluminum bends 45 degrees backwards at these locations. These bends give the crossbar (800*b*) a door handle shape.

Because of the bends, the Rip n' Grip™ surface (848) of the second version of the lower crossbar (800B) is pushed forward so that the Rip n' Grip™ self-adhesive hook pad (838) can be applied directly to Rip n' Grip™ surface (848) on the crossbar (818B) rather than requiring a Rip n' Grip™ block (830) as in the previous version (818A). Also, with this crossbar (800*b*), the quick-lock (718/802) is fastened in a more forward position than with the first crossbar version (818A), thus altering somewhat the dynamics of the upward and downward pivoting of the tray assembly (900A or B). Further, this crossbar (800B) may be flipped over and assembled with the slots closer to what is then the top edge of the crossbar (800*b*) rather than in the configuration shown (FIG. 8B), thus altering the dynamics and relationships of the connected trays (902).

Referring to FIG. 8C, a blowup of the front quick lock (802) is shown.

Referring to FIG. 9A, an example of a tray/tray spine/L-bracket/lower cross bar assembly (900A) is shown. The example given contains 2 trays (902). Each tray (902) is made from one eighth inch thick 6061 aircraft quality aluminum and is approximately seven and one half inches long and six inches wide. The outside perimeter of the tray (902) is somewhat L-shaped as shown. There are various openings (904) made through the surface of the tray. One of the functions of these openings is to reduce the amount of aluminum used and therefore make the weight of the trays (902) lighter. A second function of these openings (904) is to allow a user to reach underneath and through the openings (904) in order to access the underside of any items that are sitting on the tray (902) without having to lift or unfasten those items. Around the perimeter of the tray (902), there are 6 'bungee buds' (906). These 'bungee buds' (906) are t-shaped inlets into the edges of the tray (902) which allow bungee cords (1202) with end protectors (1204) to be removably locked into position in the 'bungee buds' (906) in order to secure various items to the tray (902). The 'T' crossbar of these T-shaped 'bungee bud' (906) inlets is five eighths inches long by three sixteenths of an inch wide. The inlet to the 't' is three sixteenths inches wide and one eighth of an inch long.

The tray also contains 4 three sixteenths inches wide rounded end slots (910) of various length, and 6 10/32 tapped holes (908) placed over the surface of the tray (902) to allow various connections to be made in different positions to the tray spine (912A or B) or the tilt wrist rest (1102). The tray spine (912A or b) must be attached to the tray (902) using the 10/32 tapped attachment holes (908). The tilt wrist rest (1102) may be attached to the tray (902) using either the attachment holes (908) or the slots (910).

The tray spine (912A) is a length of three sixteenths of an inch thick 6061 aircraft quality aluminum seven inches long and three quarters of an inch wide. There are 2 seven thirty-seconds inch diameter untapped counter-sunk L-bracket attachment holes (930) centered along the middle of the width of the tray spine (912A) at seven eighths of an inch and one quarter of an inch respectively from the rear end (932) of the tray spine (912A). The tray spine (912A) has 2 seven thirty-seconds inch wide slots (1002) (1004) with rounded ends cut through its center along its length. The rear slot (1002) extends from one and three eighths inches from the rear end (932) of the tray spine (912*a*) to three and seven eighths inches from the rear end (932) of the tray spine (912*a*). The front slot (1004) extends from one quarter inch from the front end (1006) of the tray spine (912*a*) to two and seven eighths inches from the front end (1006) of the tray spine (912*a*). The long outside edges of the tray spine are straight.

The L-bracket (914) is crafted of larger 6061 aluminum bar stock. One arm of the 'L' is one and one eighth inches long and three quarters of an inch wide and is one quarter of an inch thick. There are 2 10/32 tapped tray spine attachment holes (918) through the center of the width of this arm of the L-bracket (914) positioned at one quarter inch and seven eighths of an inch away from the end of this arm of the L-bracket respectively. The other arm of the L-bracket is positioned vertically and is one and one quarter inches long, three quarters inches wide, and three eighths of an inch thick. There is a slider (928) three eighths of an inch wide, which juts out into the inside of the 'L' of the L-bracket (914). A single 10/32 tapped lower crossbar attachment hole (916) penetrates through the vertical arm of the L-bracket and through the center of the slider (928). It is centered at three eighths of an inch from the end of this arm of the L-bracket (914).

The tray spine (912A) is assembled to the L-bracket (914) by inserting 2 one half inch Long stainless steel flanged bolts with hex head inserts (H-10) through the counter-sunk untapped attachment holes (930) in the tray spine (912A) and into 10/32 tapped attachment holes in the L-bracket (918). Referring to FIG. 9B, an example of a tray/tray spine with L-bracket combination piece/lower cross bar assembly (900B) is shown. The one piece tray spine/L-bracket combination piece (912B) shown here may be substituted for the L-bracket (914)/tray spine (912A) assembly above.

The L-bracket (914)/tray spine (912A) assembly or L-bracket/tray spine combination piece (912B) is then fastened to the lower crossbar (818A or B) using a one inch diameter plastic knob with brass 10/32 tapped insert (H-32) with a three quarter inch long all-thread Allen bolt (H-2) inserted. First a nylon washer (H-40) is placed upon the three quarter inch long all-thread Allen bolt (H-2) and then the bolt (H-2) is inserted through the slot (820A or B) in the lower crossbar (818A or B) and into the 10/32 tapped attachment hole (916) in the vertical arm of the L-bracket (918) or into the 10/32 tapped attachment hole (926) in the L-bracket/tray spine combination piece (912B). In this assembled position, the slider (928 or 924) is engaged into the lower crossbar slot (820 a or b). The knob (H-32) is may be tightened or loosened to allow the L-bracket (914)/tray spine (912A)/tray (902) assembly or L-bracket/tray spine combination (912B)/tray (902) assembly to slide along the lower crossbar slot (820*a* or *b*) or to secure the assembly in any desired position.

The tray (902) may be fastened to the tray spine (912 A or B) in many different configurations. 2 one half inch diameter press fit plastic knobs to fit 10/32 hex head (H-30) with one half inch long hex head Allen bolts (H-6) inserted are utilized to secure the tray (902) to the tray spine (912A or B). The bolts (H-6) are inserted one through each tray spine slot (1002) (1004) or both through one of the slots, and into any of the 10/32 tapped holes (908) in the tray (902).

Referring to FIG. 10A, an example of a tray/tray spine/L-bracket assembly (100A) is shown.

Referring to FIG. 10B, a second configuration of an example of a tray/tray spine/L-bracket assembly (1000B) is shown.

Referring to FIG. 10C, a third configuration of an example of a tray/tray spine/L-bracket assembly (1000C) is shown.

Referring to FIG. 10D, a fourth configuration of an example of a tray/tray spine/L-bracket assembly (1000D) is shown.

Referring to FIG. 11A, an example of a left tray/tilt wrist rest assembly (1100A) is shown. The left tilt wrist rest (1102) is a length of one eighth inch thick 6061 aircraft quality aluminum approximately six and one half inches long and one and three eighths inches at its widest section. The width of the left tilt wrist rest (1102) narrows from one edge (1106) around the middle of its length so that one half of the length of the left tilt wrist rest (1102) is wider than the other. The narrow half is one and one eighth inches in width. The left tilt wrist rest (1102) has 2 seven thirty-seconds of an inch wide slots, a wide end slot (1104) and a narrow end slot (1126), both with rounded ends, cut consecutively along its length. The wide end slot (1104) extends from one quarter of an inch from the rear end of the left tilt wrist rest (1102) to three and one eighth inches from that same end of the left tilt wrist rest (1102). The narrow end slot (1126) extends from one quarter of an inch from the front end of the left tilt wrist rest (1102) to three inches from the front end of the left tilt wrist rest (1102). Both slots are placed along the center of the width for that section of the wrist rest. The slots (1104) (1126) are beveled on one face of the wrist rest (1102) but there is no bevel on the other face.

The right tilt wrist rest (1502) is nearly identical to the left tilt wrist rest (1102). The only difference between the two is which of the two faces of the wrist rest (1102) (1502) has beveled slots (1104) (1126) and which face is flat surrounding the slots (1104) (1126). Rather than being identical, the 2 wrist rests (1102) (1502) are mirror images of one another and since they are interchangeable with one another depending upon preference, they are more properly called a matched set, rather than simply left and right.

There are two 6061 aluminum hexagonal spacers cut from hexagonal bar stock, a large hexagonal spacer (1108) and a small hexagonal spacer (1116), included for each wrist rest (1102) (1502). The large hexagonal spacer (1108) is three quarters of an inch long, has an outside width from side to side of one half inch across and a ten thirty-seconds inch diameter bolt hole (1110) through its length. One end of the large hexagonal spacer is flat (1112) and one end is cut at a 15 degree angle (1114). The small hexagonal spacer (1116) is three eighths of an inch long, has an outside width from side to side of one half inch across and a seven thirty-seconds inch diameter bolt hole (1118) through its length. One end of the small hexagonal spacer is flat (1120) and the other end is cut at a 15 degree angle (1122).

Using one hexagonal spacer (1108) (1116) configuration, The wrist rest (1102) (1502) is attached to the tray with a one and one quarter inch stainless steel flange bolt with hex head insert (H-12) which is inserted through either the wide end slot (1104) in the wrist rest (1102) (1502) or the narrow end slot (1106) in the wrist rest (1102) (1502) then through a nylon washer (H-40) then through the large hexagonal spacer (1108) oriented with flat end (1112) upwards, then through a slot (910) or hole (908) in the tray (902) and then into the small hexagonal spacer (1116) oriented with flat end (1120) downwards, then through a nylon washer (h-40) and finally into a one inch diameter plastic knob with brass 10/32 tapped insert (H-32). The knob (H-32) is tightened to secure the wrist rest (1102) (1502) or loosened in order to slide, turn or re-angle the wrist rest (1102) (1502). The knob (H-32) is fully released in order to disassemble the pieces and reattach the wrist rest (1102) (1502) through a different hole (908) or slot (910) in the tray (902) or with a new hexagonal spacer (1116) (1108) configuration.

The hexagonal spacers (1108) (1116) may be configured in several different ways to raise lower, flatten or tilt the wrist rest (1102) (1502). Referring to FIG. 11B, 3 alternative hexagonal spacer configurations are shown. The hexagonal spacers (1108) (1116) are shown in relation to the tilt wrist rest (1102) (1502). The edge of the tray (902) is visible in this side view. Configuration II is the configuration illustrated in FIG. 11A. This configuration results in a medium height tilted wrist rest (1102) (1502).

Two other alternative hexagonal spacer (1108) (1116) configurations are illustrated here. Configuration I has the small hexagonal spacer (1116) flat end (1120) upwards above the tray (902) and the large hexagonal spacer (1108) flat end (1112) downwards below the tray (902). This makes for a tilted wrist rest (1102) (1502) lower than in configuration II. Configuration III has both the large hexagonal spacer (1108) and the small hexagonal spacer (1116) stacked above the tray (902). This results in a flat high wrist rest (1102) (1502). It should be noted that in both configuration I and configuration III The exposed flat end of the hexagonal spacer (1108, 1116) above the tray (902) makes an angle with the horizontal and depending on the exact positioning of the wrist rest (1102, 1502) upon the hexagonal spacer (1108, 1116), the wrist rest may be tilted in any desired direction—forward, back, to either side, or toward any direction in between. This is a unique feature of the current invention.

Referring to FIG. 12A, an example of a 'bungee bud' with bungee cord and end protector (1200A) is shown. The bungee cord (1202) with end protector (1204) slipped over a knot (1206) at the end of the bungee cord (1202) is engaged into the 'bungee bud' (906) along the edge of the tray (902). The end protector (1204) cannot pull upward through the 'bungee bud' (906) once so engaged. By engaging each end of a bungee cord (1202) in separate 'bungee buds' (906) in this manner, the bungee cord (1202) may be used to lock down various items to the tray (902).

Referring to FIG. 12B, an example of an R/C transmitter utilizing the 'bungee bud' lockdown system (1200B) is shown. The two ends of the bungee cord (1202) are engaged in 'bungee buds' (906) while the two end protectors (1204) hold the ends of the cord (1202) in position. The bungee cord (1202) is wrapped around the carrying handle (1210) of an R/C transmitter (1208) thereby locking the transmitter (1208) to the tray (902).

Referring to FIG. 13, an example of an R/C transmitter with Rip n' Grip™ loop and hook fastening system (1300) is shown. The Rip n' Grip™ self-adhesive loop pad (1302) has been affixed to the rear of the R/C transmitter (1208). As the transmitter is slid backward on the trays (902) the Rip n' Grip™ loop pad (1302) engages with the Rip n' Grip™ hook pad (838) affixed to the Rip n' Grip™ block (830) or lower crossbar (818*b*). The 2 Rip n' Grip™ pads (1302) (838) interlock to create a disengageable lockdown of the R/C transmitter (1208). Other Rip n' Grip™ pads or other hook and loop fasteners may be utilized in different locations on the wearable tray system (100) for fastening as desired.

Referring to FIG. 14A, an example of a hard lockdown assembly (1400A) is shown. This example of a hard lockdown bar (1402) has a body (1420) and 2 upright arms (1406). The body (1420) is six and one half inches long and one inch wide and has a five and one half inch long seven sixteenths inch wide slot (1404) with rounded ends cut through its center running along the length of the body (1420) of the hard lockdown bar (1402).

The 2 upright arms (1406) of the hard lockdown bar (1402) are each two inches long, three quarters inches wide, and one eighth inch thick. The two arms (1406) are one and one half inches apart and one and three quarters inches from the end of the body (1420) of the hard lockdown bar (1402). Each upright arm (1406) has a one and one half inch long three eighths of an inch wide slot (1408) with rounded ends cut through its center running along its length. The slot (1408) extends from one quarter inch from the upper end of the arm (1406) to one and three quarters inches from the upper end of the upright arm (1406).

The body (1420) and upright arms (1406) of the hard lockdown bar (1402) in this example are fabricated from one sheet of material and so there is a bend (1410) where the body (1420) of the hard lockdown bar (1402) becomes each upright arm (1406).

To assemble the hard lockdown system, the hard lockdown bar (1402) is first attached to the front edge of the trays (902). 2 one half inch diameter press fit plastic knob to fit 10/32 hex head (H-30) with one half inch long hex head Allen bolts (H-6) inserted are utilized. The bolts (H-6) are inserted through nylon washers (H-40) and up through the slot (1404) In the body (1420) of the hard lockdown bar (1402) and into a 10/32 tapped hole (908) in the front edge of the tray (902).

Then to lock down the transmitter lockdown bar (1210), 2 one inch diameter plastic knobs with brass 10/32 tapped inserts (H-32) with One inch long Allen bolts (H-22) inserted are utilized. A nylon washer is placed upon each of the two bolts (H-22). One bolt (H-22) with knob (H-32) attached and nylon washer (H-40) disposed thereon is inserted through each upright arm (1406) of the hard lockdown bar (1402) and into a 1" long 10/32 tapped all-threaded sleeve (1412). A one inch long soft plastic surgical tubing sleeve guard (1416) is fitted onto each sleeve (1412).

Referring to FIG. 14B, a side view of an example of a hard lockdown assembly locking down the carrying handle bar of an R/C transmitter (1400*b*) is shown. The bolts (H-22) with sleeves (1412) and sleeve guards (1416) thereupon are slid along the slots (1408) in the upright arms (1406) into proper position resting upon the lockdown bar (1210) of the transmitter (1208). The knobs (H-32) are then used to tighten the bolts (H-22) with sleeves (1412) and sleeve guards (1416) upon them into position, thereby locking down the transmitter (1208).

Referring to FIG. 15, an example of an assembled wearable tray system is shown.

All measurements given above are typical. The device can be made in any size and the examples of measurements given are not meant to limit the scope of the invention in any way. Variations in tray shapes, hole patterns, 'bungee bud' placement, 'wave-grip' patterns, etc. can all be made without changing the essence of the invention.

An embodiment of the above example of the wearable tray system (100) has been fabricated from 6061 aircraft quality aluminum, hardened steel, stainless steel, brass, and plastic, but its construction is not limited to these materials. It may be made from any suitable materials including but not limited to plastic, carbon fiber, extruded material, milled material, molded material, wood products, metals and synthetic materials that meet the needs of its applications. Most of The 6061, aircraft quality aluminum utilized in the example originates as ⅛ inch thick four by eight-foot sheets of material but may also be made form bar stock of suitable sizes. Some of The 6061 aircraft quality aluminum also originates as one or two inch square billets. The 6061 aluminum has been machined, milled, drilled and punched out, on CNC equipment. 6061 aluminum has been chosen for this embodiment of the wearable tray system because of its lightweight and excellent properties during anodizing. All custom machined parts for the device are anodized to military specs, level two. The tooling includes the use of a hydraulic brake and specialty jigs to facilitate the forming of the device's shoulder straps that are key to the wearability of the tray system.

Operation

The wearable tray system is adjustable in multiple dimensions to accommodate the wearer's size, sense of comfort and purpose. The given example of the wearable tray system (100) is a tool-free system, and may be broken down into its basic assemblies and/or reassembled without the need of any tools. Tools are not required to make any of the adjustments as part of the operation of the device. In other embodiments, the use of tools may be desirable. Every embodiment will have its own requirements that are appropriate for the safe, successful operation of the device.

To use the wearable tray system (100), one may pick it up from the rear with the system's trays (902) facing away from the wearer, and slide the shoulder straps (200) into place over the shoulders. Alternatively, if desired, the wearable tray system may be picked up from the front and then rotated horizontally into the appropriate wearing position. When in place, the two trays (902), with their tilting wrist rests (1102) (1502), face forward extending out and away from the wearer's midriff.

The two shoulder straps (200) can be fitted to the size of the wearer's shoulders. Each strap (200) may be bent to open up or close the curve (206) of the shoulder strap (200) to fit the wearer's body. These adjustments should be executed in small increments with light pressure until the correct shape for the wearer has been obtained. In addition the length of the strap (200) may be adjusted by bending the straps (200) at either of the two relief points (214,216,218,220,222,224) that are machined into the edge. These relief points (214,216,218,220,222,224) offer a predetermined place to facilitate the bending of the straps (200) to shorten them. Bending at these points is particularly helpful when fitting a man or woman of small stature or when fitting a man or woman with a large chest requiring extra room.

When the shoulder straps (200) are bent at the relief points (214,216,218,220,222,224) the result is a change in the overall dimension between the tops of the shoulder straps (200) as related to the upper chest crossbars (310). When the strap (200) is bent at the relief points (214,216,218,220,222,224) additional room for the breast area of the user is created. In essence, the straps (200) become longer, because the arc of the strap (206) begins sooner. A portion of straight part of the front of the shoulder strap (200) has been converted into part of the arc (206) of the shoulder strap. The result is a lifting of the upper chest crossbars (310) higher than originally fitted resulting in extra room above the breast of the wearer.

For further adjustment, the shoulder straps (200), also individually rotate out to the sides around the Allen bolt (H-2) knobs (H-32) that connect them to the upper chest cross bars (310). The bolt (H-16 or H-18) creates a stop as it hits either end of the 45° arc pin guide (314) upon rotation of the shoulder strap (200) outward or inward. Stops are included to limit this motion to the arc which extends from vertical out to the sides until forty-five degrees above horizontal. The purpose of these stops is to prevent the shoulder strap (200) from coming in contact with the wearer's neck or head at one extreme of adjustment, and to prevent the shoulder strap (200) from slipping off the wearer's shoulders at the other extreme of adjustment.

The upper chest cross bar assembly (500) is adjustable by releasing the upper 'wave-grip' knob (H-32) and resetting the upper cross bar pieces (310) and the upper 'wave-grip' fastening bracket (518) in a different configuration. The upper chest crossbar assembly (500) may be extended or shortened so as to widen or narrow the distance between the shoulder straps (200).

The length of the spine (502/602) is also adjustable, allowing the tray assembly (900A or B) to be raised or lowered as desired. After detaching the center 'wave-grip' assembly (600), the 2 spine pieces (502) (602) and center 'wave-grip' assembly (600) may be reconfigured and reassembled so as to make the spine (502/602) shorter or longer. Further, as another option, the upper spine (502) may be removed and the lower spine (602) directly attached to the upper chest crossbar assembly (500), eliminating the center 'wave-grip' assembly (600) altogether.

The device further includes a belt buckle (708) with two belt attachment rings (732) located at the base of the lower spine (602). A belt or cord or the like can be threaded through these belt attachment rings (732) and then fastened around the waist so as to secure the device to the body. This belt buckle (708) serves the further purpose of distributing the pressure of the device against the body over a larger surface area, thereby providing greater comfort for the user.

The given example of the wearable tray system (100) also includes a Rip n' Grip™ block bolted through the lower crossbar (818A) and into the front quick-lock assembly (802). This Rip n' Grip™ block (830) provides a surface covered with the self-adhesive hook pad (838) of the Rip n' Grip™ fastener. The self-adhesive loop pad (1302) of the fastener can be secured to a R/C transmitter (1208) or any other equipment to be placed on the tray (902). When the self-adhesive loop pad (1302) and self-adhesive hook pad (838) of the fastener are engaged with one another, an attachment is created to hold said transmitter (1208) or equipment more securely in position. In other embodiments the Rip n' Grip™ fastener or the like may be utilized in any other position desired.

A pre-cut Rip n' Grip™ loop pad (1302) with self-adhesive backing is applied to the base of the transmitter. This pad engages with the Rip n' Grip™ self-adhesive hook pad (838) that has been applied to the Rip n' Grip™ block (830). The transmitter (1208) with applied loop pad (1302) is then pressed onto the block's hook pad (838) forming a removable interlocking bond. The 'bungee bud' system (1200A) may then be slipped into place over the transmitter's carrying handle (1210) as a further measure to secure the transmitter (1208).

The example of the wearable tray system (100) given includes two independently functioning trays (902). The trays (902) are detachable, reversible, and interchangeable. Further, different tray (902) sizes and shapes may be substituted.

The trays (902) may be adjusted in several ways. First, the angle that the entire tray assembly (900A OR B) including the lower crossbar (818 A or B), tray spines (912 A or B), L-bracket (914) and trays (902), makes with the horizontal may be adjusted via the quick-lock pivot assembly (718/802). Using the quick-lock knob (H-34), the entire tray assembly (900 A or B) may be tilted while the wearer remains vertical so that the tray assembly (900 A or B) can be set at any angle to the horizontal ranging from 90 degrees above to 90 degrees or more below horizontal.

Each tray (902) is also separately adjustable. First, using the knobs (H-32) on the lower crossbar (818A or B), each tray (902) may be slid to the right or left along the slots (820A or b) in the lower crossbar (818A or B). Second, utilizing knobs (H-30) on the tray spine (912 A or B), the trays (902) may be adjusted forward or back, away from or towards the wearer via the tray spine slots (1002) (1004). In addition to sliding adjustments, the trays (902) may be arranged into numerous other configurations by removing knobs (H-30) on the tray spine (912 A or b) and resetting the trays (902) in new positions and reattaching them with the knobs (H-30) with inserted bolts (H-6) into any of the attachment holes (908) in the tray (902).

Using the knobs (H-32) for the tilting wrist rests (1102) (1502), the tilting wrist rests (1102) (1502) may be adjusted in numerous ways. First, the tilting wrist rests (1102) (1502) may be removed and reattached in any of the wrist rest slots (910) or tray spine holes (908). The tilting wrist rests (1102) (1502) may also be attached to the bottom of the trays (902)

if desired so as to function as feet for the device (100) when it is resting on the ground. The angle of tilt of the wrist rests (1102) (1502) may be set at either zero or fifteen degrees by reconfiguring the hexagonal wrist rest spacers (1108) (1116). Also, with the two hexagonal spacers (1108) (1116) included for each wrist rest (1102) (1502) in the current example, the height of the tilt wrist rests (1102) (1502) may be adjusted to any of three positions by reconfiguring the hexagonal spacer (1108) (1116) arrangement. The tilt wrist rests (1102) (1502), once attached may be slid along the wrist rest slots (910) for further adjustment. The tilt wrist rests (1102) (1502) may also be rotated and set at any position in the plane of the tray assembly (900A or B). In addition to its primary function, the tilt wrist rest (1102) (1502) may also be utilized as an armature to which other attachments may be secured.

Although the wearable tray system (100) may be used with or without engaging any lock down system, several alternative systems for securing items to the trays are provided:

First, the Rip n' Grip™ hook pad (838) which is adhered to the Rip n' Grip™ block (830) may be engaged with its counterpart Rip n' Grip™ loop pad (1302) which is adhered to a transmitter (1208) or other item to be held on the tray(s) (902). As mentioned above, other brands of hook and loop fasteners such as Velcro™, may be utilized. Further, these hook and loop fasteners may be applied to other areas of the wearable tray system (100), besides to the Rip n' Grip™ block, and utilized to secure items with the corresponding fastening pad appropriately placed, to the wearable tray system (100).

Second, the 'bungee bud' system (1200A) allows bungee cords (1202) to be conveniently used in any of numerous configurations to strap items to the tray (902). The bungee buds (906) placed around the perimeter of the tray (902) create numerous hooking points to which bungee cords (1202) with end protectors (1204) can be easily and quickly engaged and from which they can be equally quickly and easily released. to lock down an R/C transmitter (1208), a bungee cord (1202) is wrapped around the transmitter carrying handle (1210) in a loop and then engaged with 'bungee buds' (906) to tighten down into position.

A third, optional hard lockdown system (1400A) is also disclosed. When utilized, this hard lockdown system (1400A) creates a firm attachment between the tray (902) and an R/C transmitter carrying handle (1210) or the like. To engage the system, the all-threaded sleeves (1412) with sleeve guards (1416) slide down upon the transmitter carrying handle (1210) and the pressure holds the transmitter (1208) in place. The vertical arm slots (1408) allow bolts (H-22) to slide up and down. The hard lockdown bar (1402) bolts to the underside of both trays (902). The lower crossbar slot (820 A or B) allows the trays (902) to open and close as desired. The hard lockdown assembly (1400 A) allows the user to secure a transmitter carrying handle (1210) without the use of the 'bungee bud' system (1200A). However the 'bungee bud' system (1200A) and/or the Rip n' Grip™ hook (838) and loop (1302) fasteners may also be used in conjunction with the hard lockdown assembly (1400A).

I claim:

1. A solid structural member of incrementally adjustable length comprising:

a first solid length of material having two ends, two widthwise faces, two lengthwise edges, and two lengthwise faces, said lengthwise edges having some portion of their length shaped into one or more repetitions of a base pattern and each widthwise face extends between the two lengthwise edges;

a second solid length of material having two ends, two widthwise faces, two lengthwise edges, and two lengthwise faces, said lengthwise edge having some portion of their length shaped into multiple repetitions of said base pattern and each widthwise face extends between the two lengthwise edges; and a fastening bracket with inner surfaces designed to interlock snugly into one or more repetitions of said base pattern such that when one of said widthwise faces of said first solid length of material is brought to abut one of said widthwise faces of said second solid length of material such that one or more repetitions of said base pattern along said lengthwise edges of said first solid length of material are aligned with one or more repetitions of said base pattern along said lengthwise edges of said second solid length of material, said fastening bracket may be engaged into one or more aligned base patterns so as to securely fasten said first and second solid lengths of material together to form a single solid structural member of fixed length;

wherein said fastening bracket may be disengaged from said solid lengths of material and said solid lengths of material rearranged into other positions relative to one another such that one or more repetitions of said base pattern along said lengthwise edges of said first solid length of material are aligned with one or more repetitions of said base pattern along said lengthwise edge of said second solid length of material, allowing for reassembly of said bracket with said first and second solid lengths of material into any of numerous configurations so as to create a solid structural member of any of multiple fixed lengths, wherein said solid lengths of material abut against each other on only one widthwise face when engaged to each other by the fastening bracket in a non-telescoping configuration; and wherein said base pattern is a concave wave trough and the corresponding interior surfaces of said fastening bracket are shaped into wave crests complementary to said concave wave through.

2. A solid structural member of incrementally adjustable length comprising:

a first solid length of material having two ends, two lengthwise edges and two lengthwise faces, said lengthwise edges having some portion of their length shaped into one or more repetitions of a base pattern and each widthwise face extends between the two lengthwise edges;

a second solid length of material having two ends, two lengthwise edges and two lengthwise faces, said lengthwise edge having some portion of their length shaped into multiple repetitions of said base pattern and each widthwise face extends between the two lengthwise edges; and a fastening bracket with inner surfaces designed to interlock snugly into one or more repetitions of said base pattern such that when one of said lengthwise faces of said first solid length of material is brought to abut one of said lengthwise faces of said second solid length of material such that one or more repetitions of said base pattern along said lengthwise edges of said first solid length of material are aligned with one or more repetitions of said base pattern along said lengthwise edges of said second solid length of material, said fastening bracket may be engaged into one or more aligned base patterns so as to securely fasten said first and second solid lengths of material together to form a single solid structural member of fixed length;

wherein said fastening bracket may be disengaged from said solid lengths of material and said solid lengths of material rearranged into other positions relative to one another such that one or more repetitions of said base pattern along said lengthwise edges of said first solid length of material are aligned with one or more repetitions of said base pattern along said lengthwise edge of said second solid length of material, allowing for reassembly of said bracket with said first and second solid lengths of material into any of numerous configurations so as to create a solid structural member of any of multiple fixed lengths, wherein each solid length of material has a one engaging face and the solid lengths of material engage each other only along their engaging faces in a non-telescoping configuration; and wherein each solid length of material has a slot through its faces' middle along a portion of its length and said fastening bracket has an outcropping designed to fit snugly into said slot when said bracket is engaged with said solid lengths of material.

3. A solid structural member of incrementally adjustable length comprising:

a first solid length of material having two ends, two widthwise faces, two lengthwise edges, and two lengthwise faces, said lengthwise edges having some portion of their length shaped into one or more repetitions of a base pattern and each widthwise face extends between the two lengthwise edges;

a second solid length of material having two ends, two widthwise faces, two lengthwise edges, and two lengthwise faces, said lengthwise edge having some portion of their length shaped into multiple repetitions of said base pattern and each widthwise face extends between the two lengthwise edges; and a fastening bracket with inner surfaces designed to interlock snugly into one or more repetitions of said base pattern such that when one of said widthwise faces of said first solid length of material is brought to abut one of said widthwise faces of said second solid length of material such that one or more repetitions of said base pattern along said lengthwise edges of said first solid length of material are aligned with one or more repetitions of said base pattern along said lengthwise edges of said second solid length of material, said fastening bracket may be engaged into one or more aligned base patterns so as to securely fasten said first and second solid lengths of material together to form a single solid structural member of fixed length;

wherein said fastening bracket may be disengaged from said solid lengths of material and said solid lengths of material rearranged into other positions relative to one another such that one or more repetitions of said base pattern along said lengthwise edges of said first solid length of material are aligned with one or more repetitions' of said base pattern along said lengthwise edge of said second solid length of material, allowing for reassembly of said bracket with said first and second solid lengths of material into any of numerous configurations so as to create a solid structural member of any of multiple fixed lengths, wherein said solid lengths of material abut against each other on only one widthwise face when engaged to each other by the fastening bracket in a non-telescoping configuration; and wherein said solid lengths of material are symmetrical with respect to their lengthwise axes and are therefore reversible.

* * * * *

UNITED STATES PATENT AND TRADEMARK OFFICE

CERTIFICATE OF CORRECTION

PATENT NO. : 7,591,401 B2
APPLICATION NO. : 11/054099
DATED : September 22, 2009
INVENTOR(S) : Jeffrey Lawrence Sandler It is certified that error appears in the above-identified patent and that said Letters Patent is hereby corrected as shown below:

Column 5
Line 6, change "960A" to --900A--

Column 9
Line 2, after the word, "Parts," delete "(H-30)"

Column 17
Line 2, after the word, "Velcro™" delete the letter "T"

Column 19
Line 48, change "(100A)" to --(1000A)--

Signed and Sealed this

Seventeenth Day of November, 2009

David J. Kappos

David J. Kappos
*Director of the United States Patent and Trademark Office*